US010071793B2

(12) United States Patent
Koyano et al.

(10) Patent No.: US 10,071,793 B2
(45) Date of Patent: Sep. 11, 2018

(54) JET PROPULSION BOAT

(71) Applicant: YAMAHA HATSUDOKI KABUSHIKI KAISHA, Shizuoka-Ken (JP)

(72) Inventors: Satoshi Koyano, Shizuoka-Ken (JP); Shu Akuzawa, Shizuoka-Ken (JP)

(73) Assignee: YAMAHA HATSUDOKI KABUSHIKI KAISHA, Iwata-Shi, Shizuoka (JP)

( * ) Notice: Subject to any disclaimer, the term of this patent is extended or adjusted under 35 U.S.C. 154(b) by 0 days.

(21) Appl. No.: 15/058,936

(22) Filed: Mar. 2, 2016

(65) Prior Publication Data

US 2016/0347433 A1 Dec. 1, 2016

(30) Foreign Application Priority Data

May 26, 2015 (JP) ..... 2015-106582

(51) Int. Cl.

| | |
|---|---|
| ***B63H 25/46*** | (2006.01) |
| ***B63H 11/107*** | (2006.01) |
| *B63H 11/113* | (2006.01) |
| *B63H 11/00* | (2006.01) |

(52) U.S. Cl.

CPC ..... *B63H 11/107* (2013.01); *B63H 11/113* (2013.01); *B63H 2011/008* (2013.01)

(58) Field of Classification Search

CPC ..... B63H 11/10; B63H 11/101; B63H 11/107; B63H 2025/026; B63H 25/46; B63H 2011/008

See application file for complete search history.

(56) References Cited

U.S. PATENT DOCUMENTS 3,675,611 A * 7/1972 Glass ..... B63H 25/46 114/151
8,490,558 B2 7/2013 Foley et al.

FOREIGN PATENT DOCUMENTS

GB 1194510 A * 6/1970 ..... B63H 11/113
JP 2001-328593 A 11/2001

* cited by examiner

*Primary Examiner* — Andrew Polay
(74) *Attorney, Agent, or Firm* — Rabin & Berdo, P.C.

(57) ABSTRACT

A jet propulsion boat includes a propulsion device configured to generate a jet of water, a first discharge portion provided in a rear portion of a boat body, including a first discharge port from which the jet of water is discharged, a second discharge portion including a second discharge port from which the jet of water is discharged, configured to be rotatable so as to change the discharge direction of the second discharge port, and a jet path configured to connect the propulsion device to the first discharge portion and the second discharge portion.

20 Claims, 12 Drawing Sheets

BLOCK DIAGRAM OF FIRST (SECOND) EMBODIMENT

CASE WHERE THREE-WAY VALVE ALONG ARROW R IS IN SECOND POSITION

CASE WHERE THREE-WAY VALVE ALONG ARROW L IS IN FIRST POSITION

JET PROPULSION BOAT

CROSS-REFERENCE TO RELATED APPLICATION

The priority application number JP2015-106582, entitled "Jet Propulsion Boat", and filed May 26, 2015, by Satoshi Koyano and Shu Akuzawa, upon which this patent application is based, is hereby incorporated by reference in its entirety.

BACKGROUND OF THE INVENTION

Field of the Invention

The present invention relates to a jet propulsion boat.

Description of the Background Art

A jet propulsion boat including a plurality of discharge ports from which jets of water are discharged is known in general. Such a jet propulsion boat is disclosed in U.S. Pat. No. 8,490,558, for example.

U.S. Pat. No. 8,490,558 discloses a jet boat including a boat body, a left engine and a right engine provided on the boat body, a left jet propulsion unit and a right jet propulsion unit configured to generate jets of water by power of the left engine and power of the right engine, respectively, and a valve configured to switch destinations to which the jets of water are supplied. In this jet boat, the jet of water from the left jet propulsion unit is supplied to and discharged from at least one of a left main discharge port provided in a rear portion of the boat body, a rear discharge port fixedly provided in a left rear portion of the boat body, and a front discharge port fixedly provided in a right front portion of the boat body by the opening and closing of the valve. Furthermore, the jet of water from the right jet propulsion unit is supplied to and discharged from at least one of a right main discharge port provided in the rear portion of the boat body, a rear discharge port fixedly provided in a right rear portion of the boat body, and a front discharge port fixedly provided in a left front portion of the boat body by the opening and closing of the valve.

In the jet boat according to U.S. Pat. No. 8,490,558, the rear discharge ports and the front discharge ports are fixedly provided, and hence the discharge directions of the jets of water discharged from the rear discharge ports and the front discharge ports are disadvantageously fixed. In this case, it is conceivably necessary to exactly control the opening and closing of the valve and supply a proper jet of water to at least one of the main discharge port, the rear discharge port, and the front discharge port each time control for steering the boat body is performed on the basis of boat operation of a user in the jet boat. Therefore, it is necessary to properly control the opening and closing of the valve for each boat operation of the user, and delay in the steering of the jet boat corresponding to boat operation of the user is likely to occur.

SUMMARY OF THE INVENTION

The present invention has been proposed in order to solve the aforementioned problem, and to provide a jet propulsion boat in which delay in the steering of the jet propulsion boat corresponding to boat operation of a user is significantly reduced or prevented.

A jet propulsion boat according to an aspect of the present invention includes a boat body, a propulsion device configured to generate a jet of water for propelling the boat body, a first discharge portion provided in a rear portion of the boat body, including a first discharge port from which the jet of water is discharged, a second discharge portion including a second discharge port from which the jet of water is discharged, configured to be rotatable so as to change the discharge direction of the second discharge port, and a jet path configured to connect the propulsion device to the first discharge portion and the second discharge portion. The term "provided in a rear portion" means that the first discharge portion is provided rearward relative to the center of gravity of the boat body.

In the jet propulsion boat according to this aspect, as hereinabove described, the second discharge portion is configured to be rotatable so as to change the discharge direction of the second discharge port. Thus, the second discharge portion is rotated to correspond to boat operation of a user, whereby the discharge direction of the second discharge port is promptly changed, and the jet propulsion boat is steered. Thus, delay in the steering of the jet propulsion boat corresponding to the boat operation of the user is significantly reduced or prevented. Furthermore, the discharge direction of the second discharge port is simply changed to a second direction of a right-left direction on the basis of the boat operation of the user associated with movement in a first direction of the right-left direction, for example, whereby the jet propulsion boat is easily moved in the first direction of the right-left direction without exactly controlling the amount of the jet of water discharged from the second discharge port. Thus, steering corresponding to movement in the right-left direction or the like is performed without complicating control for discharging the jet of water, and hence the delay in the steering of the jet propulsion boat corresponding to the boat operation of the user is significantly reduced or prevented. Moreover, the discharge direction of the second discharge port is changed in the second discharge portion, whereby it is not necessary to provide a plurality of fixed discharge ports having discharge directions different from each other. Thus, the number of discharge ports is reduced, and hence a mechanism configured to supply the jet of water to the discharge ports is simplified while control of the amount of the jet of water is simplified. Thus, the delay in the steering of the jet propulsion boat corresponding to the boat operation of the user is significantly reduced or prevented.

In the aforementioned jet propulsion boat according to this aspect, the second discharge portion is preferably provided in a front portion of the boat body. According to this structure, the boat body is easily rotationally moved about the center of gravity and is easily moved in the right-left direction while being prevented from rotation by the first discharge portion and the second discharge portion arranged in a front-back direction through the center of gravity. The term "provided in a front portion" means that the second discharge portion is provided forward relative to the center of gravity of the boat body.

In the aforementioned jet propulsion boat according to this aspect, the second discharge portion is preferably provided on a centerline of the boat body that extends from the bow of the boat body toward the stern of the boat body. According to this structure, the jet propulsion boat is properly steered without providing a plurality of second discharge portions simply by properly rotationally controlling the second discharge portion arranged on the centerline. Thus, an increase in the number of components is significantly reduced or prevented, and the control of the amount of the jet of water is further simplified.

In the aforementioned jet propulsion boat according to this aspect, the second discharge portion is preferably configured to be rotatable 360 degrees in a horizontal plane and to be rotated by an arbitrary angle in the horizontal plane so as to change the discharge direction of the second discharge port. According to this structure, the jet of water is discharged in any direction of 360 degrees in the horizontal plane from the second discharge port, and hence complication of the control for discharging the jet of water is reliably significantly reduced or prevented. Furthermore, the second discharge portion is rotated by 360 degrees in the horizontal plane, whereby the jet of water is discharged in an arbitrary direction in the horizontal plane from the second discharge port without providing a plurality of second discharge ports. Thus, an increase in the number of components is significantly reduced or prevented, and the control of the amount of the jet of water is further simplified.

In this case, the second discharge portion is preferably L-shaped so as to discharge the jet of water supplied from above through the jet path in a substantially horizontal direction from the second discharge port. According to this structure, the jet of water supplied from above is easily discharged in any direction of 360 degrees in the horizontal plane from the second discharge port by the L-shaped second discharge portion.

The aforementioned jet propulsion boat according to this aspect preferably further includes a drive source configured to rotationally drive the second discharge portion so as to change the discharge direction of the second discharge port. According to this structure, the drive source is controlled in the jet propulsion boat such that the discharge direction of the second discharge port is automatically controlled to be a proper direction, unlike the case where the user manually rotates the second discharge portion and sets the discharge direction of the second discharge port.

In this case, the second discharge portion is preferably rotatably connected to the jet path, and includes a tube member provided with the second discharge port and a rotary shaft connected to the drive source, configured to rotate the tube member. According to this structure, the discharge direction of the second discharge port of the tube member is automatically changed by the drive force of the drive source transmitted through the rotary shaft.

In the aforementioned jet propulsion boat according to this aspect, the boat body preferably includes a storing portion configured to store the second discharge portion. According to this structure, the currently-unused second discharge portion is stored such that the possibility that the second discharge portion serves as a resistance during propulsion is significantly reduced, and hence a reduction in the speed of the jet propulsion boat caused by the second discharge portion is significantly reduced or prevented.

In this case, the storing portion preferably includes an openable and closable lid in an opening of the storing portion. According to this structure, the second discharge portion is easily switched to a storing state or a non-storing state by opening or closing the lid.

In the aforementioned jet propulsion boat according to this aspect, the jet path preferably extends from a stern side toward a bow side not to intersect with a centerline of the boat body that extends from the bow of the boat body toward the stern of the boat body. According to this structure, the jet path does not intersect with the centerline of the boat body, and hence the possibility that the jet path makes it impossible for another device to be arranged in the vicinity of the centerline in the boat body is effectively significantly reduced or prevented.

The aforementioned jet propulsion boat according to this aspect preferably further includes a jet control valve provided in the jet path and a valve controller configured to control the jet control valve to supply the jet of water from the propulsion device to at least one of the first discharge port and the second discharge port. According to this structure, the valve controller is properly controlled such that the jet of water from the propulsion device is properly supplied to at least one of the first discharge port and the second discharge port, and hence the control for discharging the jet of water is reliably performed. Furthermore, the openable and closable jet control valve and the rotatable second discharge portion are used together such that the delay in the steering of the jet propulsion boat corresponding to the boat operation of the user is more significantly reduced or prevented, as compared with the case where only the openable and closable jet control valve is used.

In this case, the propulsion device preferably includes a first propulsion device and a second propulsion device, and the valve controller is preferably configured to control the jet control valve to supply the jet of water from at least one of the first propulsion device and the second propulsion device to the second discharge port. According to this structure, it is not necessary to control the jet control valve to distribute jets of water from the first and second propulsion devices to a plurality of second discharge portions, and hence complication of control for discharging the jets of water is effectively significantly reduced or prevented.

In the aforementioned structure in which the propulsion device includes the first propulsion device and the second propulsion device, the first discharge portion preferably includes a pair of first discharge portions, the jet path preferably includes a first jet path configured to connect the first propulsion device to the second discharge portion and a second jet path configured to connect the second propulsion device to the second discharge portion, the first propulsion device is preferably connected to the first one of the pair of first discharge portions, the second propulsion device is preferably connected to the second one of the pair of first discharge portions, the jet control valve preferably includes a first three-way control valve provided in a portion where the first jet path between the first propulsion device and the first one of the pair of first discharge portions is branched and a second three-way control valve provided in a portion where the second jet path between the second propulsion device and the second one of the pair of first discharge portions is branched, and the valve controller is preferably configured to control the first three-way control valve and the second three-way control valve to selectively supply the jet of water to at least one of the second discharge portion, the first one of the pair of first discharge portions, and the second one of the pair of first discharge portions. According to this structure, the valve controller controls the first three-way control valve and the second three-way control valve to properly supply the jet of water to at least one of the second discharge portion, the first one of the pair of first discharge portions, and the second one of the pair of second discharge portions, whereby the control for discharging the jet of water is more reliably performed.

In this case, the valve controller is preferably configured to control the first three-way control valve to supply the jet of water from the first propulsion device to the first one of the pair of first discharge portions and control the second three-way control valve to supply the jet of water from the second propulsion device to the second one of the pair of first discharge portions, when the boat body is moved forward or backward. According to this structure, the boat body is propelled by the jets of water discharged from the first one of the pair of first discharge portions and the second one of the pair of first discharge portions in the case of forward movement or backward movement not requiring fine steering control, and hence it is not necessary to rotationally control the second discharge portion. Therefore, control of the jet propulsion boat during forward movement or backward movement is simplified.

The aforementioned structure including the drive source preferably further includes a joystick configured to accept operation of a user, and the drive source is preferably configured to rotationally drive the second discharge portion on the basis of the push direction of the joystick so as to adjust the discharge direction of the second discharge port. According to this structure, pushing operation of the user on the joystick is reflected in the rotational drive of the second discharge portion, and hence the jet propulsion boat is properly moved in a movement direction intended by the user according to the intuitive boat operation of the user through the joystick.

In this case, a steering operation mode of accepting the operation of the user on a steering is preferably switched to a joystick operation mode of accepting the operation of the user on the joystick when a boat speed is not more than a prescribed speed. According to this structure, the steering operation mode is switched to the joystick operation mode in which fine boat operation of the user is reflected when the boat speed is not more than the prescribed speed and fine steering control is possible, and hence the jet propulsion boat is more properly moved in the movement direction intended by the user according to the boat operation of the user through the joystick.

The aforementioned structure including the joystick preferably further includes a shift lever, and a joystick operation mode of accepting the operation of the user on the joystick is preferably cancelled and is preferably switched to a steering operation mode of accepting the operation of the user on a steering when the user operates the shift lever. According to this structure, the user easily switches the joystick operation mode to the steering operation mode in which the shift lever is used without performing an operation to cancel the joystick operation mode separately simply by operating the shift lever.

The aforementioned structure in which the steering operation mode or the joystick operation mode is switched to the joystick operation mode or the steering operation mode preferably further includes a jet control valve provided in the jet path and a valve controller configured to control the jet control valve to supply the jet of water from the propulsion device to at least one of the first discharge port and the second discharge port, and the valve controller is preferably configured to control the jet control valve to supply the jet of water to the first discharge portion and supply the jet of water to the second discharge portion through the jet path in the joystick operation mode. According to this structure, the jet of water is supplied to both the first discharge portion and the second discharge portion by the valve controller in the joystick operation mode, and hence fine steering corresponding to the movement of the jet propulsion boat in the right-left direction or the like is properly performed by both the first discharge portion and the second discharge portion.

In this case, the valve controller is preferably configured to control the jet control valve to make the amount of the jet of water supplied to the first discharge portion and the amount of the jet of water supplied to the second discharge portion substantially equal to each other and hold the boat body at a fixed point by making the discharge direction of the first discharge port and the discharge direction of the second discharge port opposite to each other, when the joystick is not operated in the joystick operation mode. According to this structure, the boat body is reliably held at a fixed point in a state where the joystick is not operated.

The aforementioned structure including the joystick preferably further includes a switching button configured to enable the user to switch a steering operation mode of accepting the operation of the user on a steering to a joystick operation mode of accepting the operation of the user on the joystick. According to this structure, the user easily switches the steering operation mode to the joystick operation mode by pressing down the switching button.

The foregoing and other objects, features, aspects, and advantages of the present invention will become more apparent from the following detailed description of the present invention when taken in conjunction with the accompanying drawings.

DESCRIPTION OF THE PREFERRED EMBODIMENTS

Embodiments of the present invention are hereinafter described with reference to the drawings.

First Embodiment (Structure of Jet Propulsion Boat)

The structure of a jet propulsion boat 100 according to a first embodiment of the present invention is now described with reference to FIGS. 1 to 9. In the figures, arrow FWD represents the forward (straight) movement direction (bow side) of the jet propulsion boat 100, and arrow BWD represents the reverse movement direction (stern side) of the jet propulsion boat 100. The movement direction including the forward movement direction and the reverse movement direction is the same as the longitudinal direction of the jet propulsion boat 100. Furthermore, in the figures, arrow R represents the starboard direction (a first direction of a width direction) of the jet propulsion boat 100, and arrow L represents the portside direction (a second direction of the width direction) of the jet propulsion boat 100.

Figure 1:
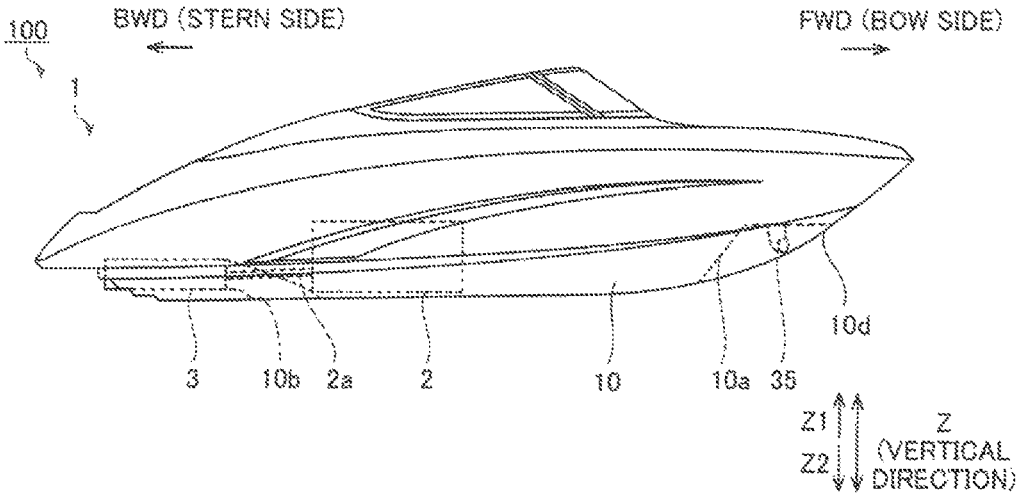
FIG. 1 is a side elevational view of a jet propulsion boat according to a first embodiment of the present invention.
Figure 2:
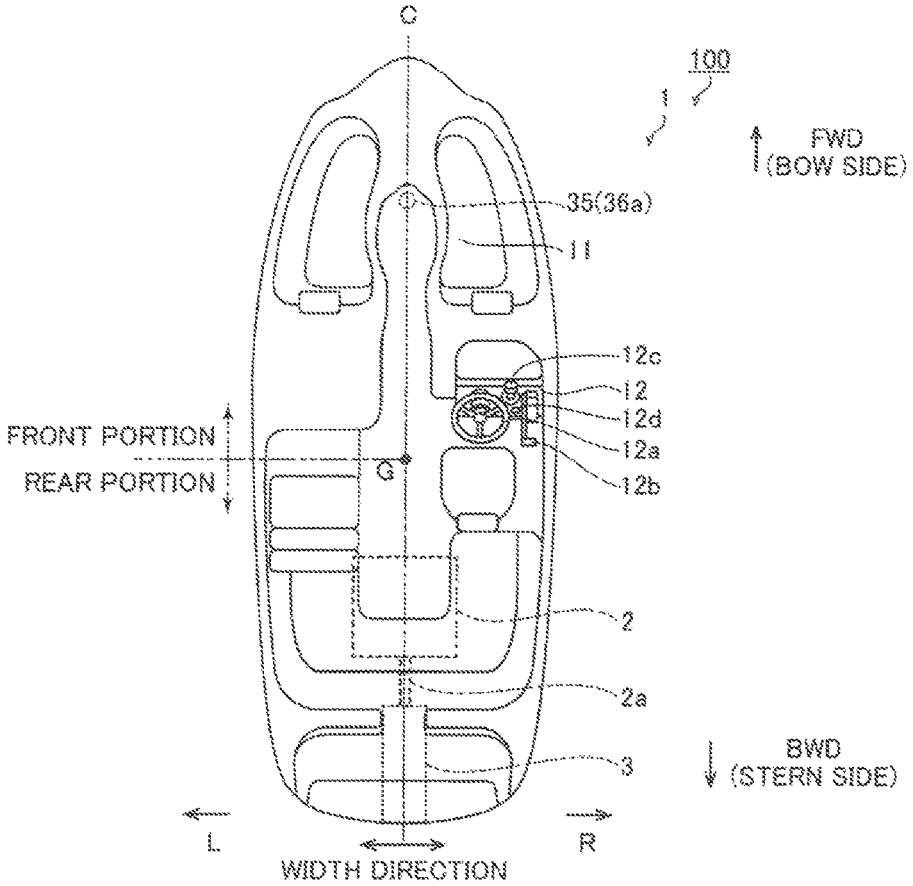
FIG. 2 is a top plan view of the jet propulsion boat according to the first embodiment of the present invention.

The jet propulsion boat 100 includes a boat body 1 including a hull 10 and a deck 11, an engine 2 stored in the hull 10, and a jet propulsion unit 3 connected to the engine 2, as shown in FIGS. 1 and 2.

The hull 10 includes the bottom of the jet propulsion boat 100, as shown in FIG. 1. The engine 2 and the jet propulsion unit 3 are arranged inside the hull 10. A storing portion 10*a* in which a rotary discharge portion 35 described later is stored is provided in a lower portion of the hull 10 on the bow side. An intake gate 10*b* through which water is supplied to the jet propulsion unit 3 is provided in a lower portion of the hull 10 on the stern side.

The deck 11 is provided to cover the hull 10 (see FIG. 1) from above (Z1 side), as shown in FIG. 2. The deck 11 is provided with a console 12 configured in order for an operator (user) to operate the jet propulsion boat 100. This console 12 is provided with a steering 12*a*, a shift lever 12*b*, a joystick 12*c*, and a mode switching button 12*d*. The mode switching button 12*d* is an example of the "switching button" in the present invention.

The jet propulsion boat 100 is provided with a steering operation mode of accepting operation of the user on the steering 12*a* and the shift lever 12*b* and a joystick operation mode of accepting operation of the user on the joystick 12*c*. The mode switching button 12*d* is provided in order for the user to switch the steering operation mode and the joystick operation mode. The steering operation mode and the joystick operation mode are described later.

The engine 2 extends from the bow of the boat body 1 to the stern of the boat body 1 and is arranged in a rear portion of the boat body 1 on a centerline C passing through the center of the boat body 1 in the width direction. The drive force of the engine 2 is transmitted to a propulsion device 30 (see FIG. 3) of the jet propulsion unit 3 arranged on the stern side relative to the engine 2 through a drive shaft 2*a* and a transmission 2*b* (see FIG. 9).

<Structure of Jet Propulsion Unit>

Figure 3:
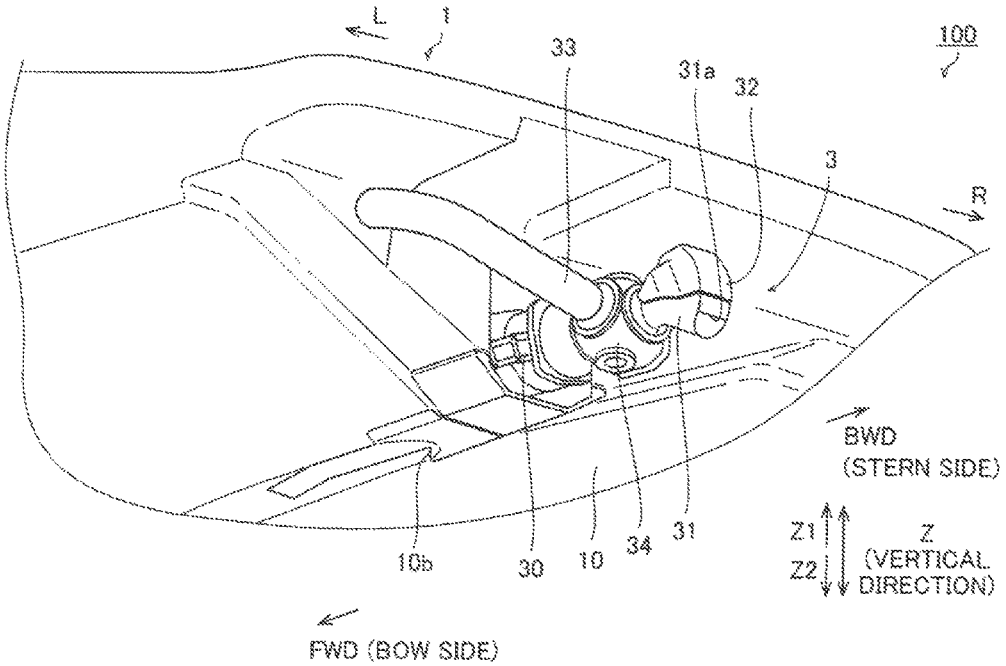
FIG. 3 is an enlarged perspective view of the jet propulsion boat according to the first embodiment of the present invention, as viewed from the rear and below.

The jet propulsion unit 3 has a function of generating a jet of water for propelling the boat body 1 on the basis of the drive force transmitted from the engine 2 and discharging the jet of water in an arbitrary direction. The jet propulsion unit 3 includes the propulsion device 30 in which an impeller (not shown) is stored and an injection nozzle 31 and a bucket 32 both configured to eject the jet of water generated in the propulsion device 30 in the arbitrary direction, as shown in FIG. 3. The propulsion device 30, the injection nozzle 31, and the bucket 32 are arranged on the centerline C (see FIG. 2) of the boat body 1. The injection nozzle 31 is an example of the "first discharge portion" in the present invention.

In the propulsion device 30, the impeller is rotated, whereby water introduced through the intake gate 10*b* of the hull 10 is compressed and the jet of water is generated.

The injection nozzle 31 includes a discharge port 31*a* from which the jet of water is discharged and a nozzle drive portion 31*b* (see FIG. 9) configured to rotate the injection nozzle 31. The nozzle drive portion 31*b* rotates the injection nozzle 31, whereby the discharge direction of the discharge port 31*a* is adjustable. The bucket 32 includes a bucket drive portion 32*a* (see FIG. 9) configured to rotate the bucket 32. The bucket 32 is arranged in a position where the bucket 32 does not cover the discharge port 31*a* when the jet propulsion boat 100 is moved forward, whereby the jet of water is discharged backward (along arrow BWD). On the other hand, the bucket 32 is arranged in a position where the bucket 32 covers the discharge port 31*a* when the jet propulsion boat 100 is moved backward, whereby the jet of water hits the bucket 32 and is discharged forward (along arrow FWD). Thus, the discharge direction of the jet of water is switched from backward to forward in the discharge port 31*a* of the injection nozzle 31. Consequently, the discharge direction of the jet of water discharged from the discharge port 31*a* of the injection nozzle 31 is adjustable to a prescribed direction in a horizontal plane including a front-back direction. FIG. 3 shows the position where the bucket 32 does not cover the discharge port 31*a* when the jet propulsion boat 100 is moved forward. The discharge port 31*a* is an example of the "first discharge port" in the present invention.

The jet propulsion unit 3 includes a branched path 33 that connects the propulsion device 30 and the rotary discharge portion 35 (see FIG. 7) described later and a three-way valve 34 connected to the propulsion device 30, the injection nozzle 31, and the branched path 33. A jet path A (see FIG. 6) in which the jet of water from the propulsion device 30 circulates is defined by the three-way valve 34 and the branched path 33. The three-way valve 34 is an example of the "jet control valve" in the present invention.

Figure 4:
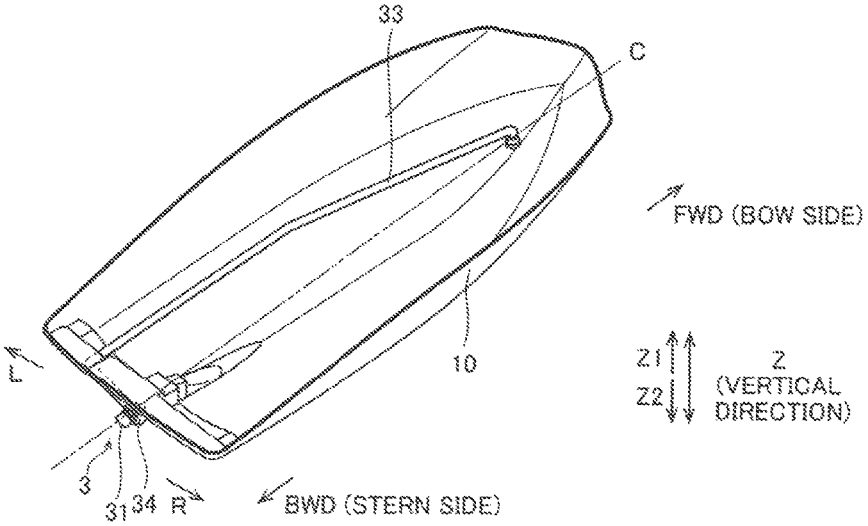
FIG. 4 is a perspective view of a boat body of the jet propulsion boat according to the first embodiment of the present invention, as viewed from above.

The branched path 33 partially includes the jet path A and is made of a tube member in which the jet of water circulates. The branched path 33 extends from the three-way valve 34 along arrow L and is bent forward, as shown in FIG. 3. The branched path 33 passes through the boat body 1 and extends forward from the stern side toward the bow side in a portion of the hull 10 of the boat body 1 along arrow L, as shown in FIG. 4. Thus, the branched path 33 is provided along arrow L relative to the centerline C of the boat body 1. In the branched path 33, the vicinity of an end 33*a* (see FIG. 8) opposite to the three-way valve 34 is bent downward on the centerline C in a front portion of the boat body 1. The end 33*a* of the branched path 33 is connected to the rotary discharge portion 35 (see FIG. 8).

Figure 5:
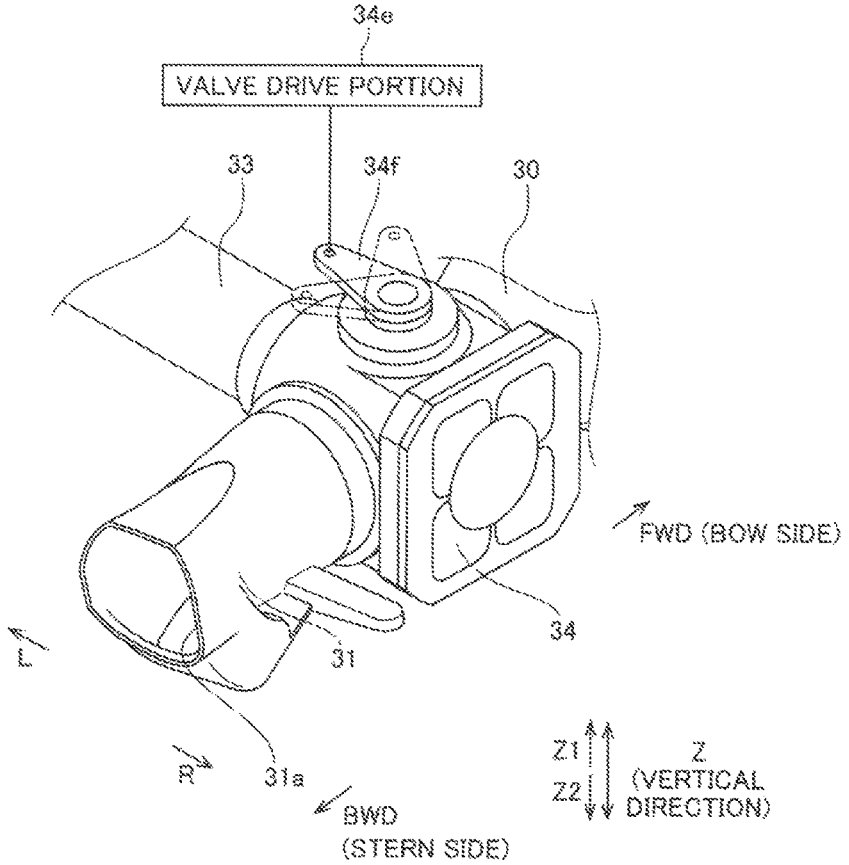
FIG. 5 is a perspective view showing a three-way valve of the jet propulsion boat according to the first embodiment of the present invention.
Figure 6:
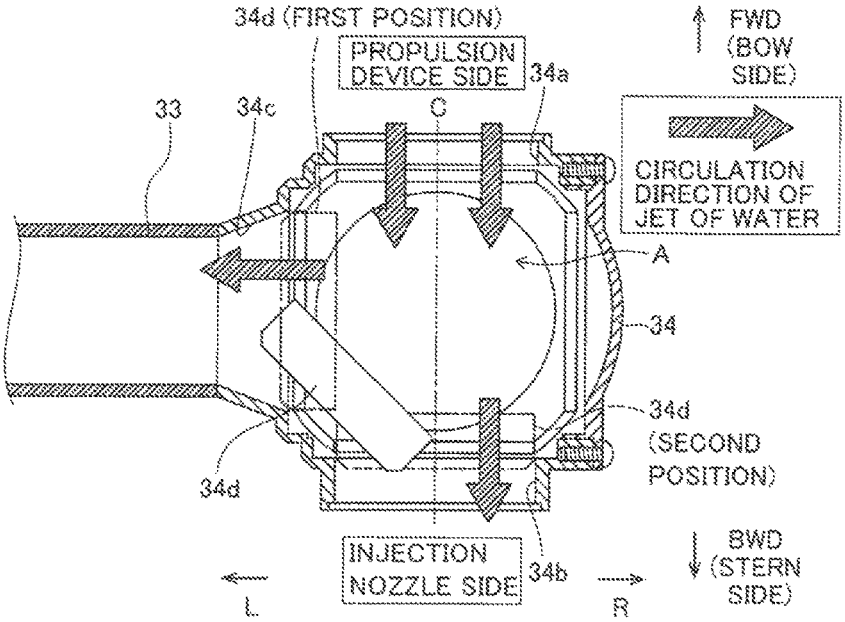
FIG. 6 is a sectional view showing the three-way valve of the jet propulsion boat according to the first embodiment of the present invention.

As shown in FIG. 5, the three-way valve 34 is provided in the jet path A to partially include the jet path A. The three-way valve 34 distributes the jet of water generated in the propulsion device 30 to the injection nozzle 31 and the branched path 33 to adjust the amount of the jet of water supplied to the injection nozzle 31 and the amount of the jet of water supplied to the branched path 33 (the rotary discharge portion 35). The three-way valve 34 includes an opening 34*a* connected to the propulsion device 30, an opening 34*b* connected to the injection nozzle 31, an opening 34*c* connected to the branched path 33, and a water stop valve 34*d* configured to open and close the openings 34*b* and 34*c*, as shown in FIG. 6. The openings 34*a* and 34*b* are provided in the front and rear on the centerline C of the boat body 1, respectively. The opening 34*c* is provided along arrow L relative to the centerline C of the boat body 1.

The three-way valve 34 further includes a valve drive portion 34*e* configured to rotationally move the water stop valve 34*d* and a lever 34*f* configured to transmit the drive force of the valve drive portion 34*e* to the water stop valve 34*d*, as shown in FIG. 5. The water stop valve 34*d* is rotationally moved by the valve drive portion 34*e* and the lever 34*f* and is moved between a first position where the water stop valve 34*d* closes the opening 34*c* closer to the branched path 33 and a second position where the water stop valve 34*d* closes the opening 34*b* closer to the injection nozzle 31, as shown in FIG. 6. Thus, the degrees of opening of the openings 34*b* and 34*c* of the three-way valve 34 are adjusted, whereby the amount of the jet of water supplied to the injection nozzle 31 and the amount of the jet of water supplied to the branched path 33 are adjusted. As such, both openings 34*b* and 34*c* may at least be partially opened in some positions of the water stop valve 34*d*. The rotary discharge portion 35 described later is rotated so that the discharge direction of a discharge port 36*a* is changed, and hence it is not necessary to change or significantly change the degrees of opening of the openings 34*b* and 34*c* of the three-way valve 34 in response to boat operation of the user, unlike the case where the jet propulsion boat 100 is steered only on the basis of the degrees of opening of the openings 34*b* and 34*c* of the three-way valve 34.

Figure 7:
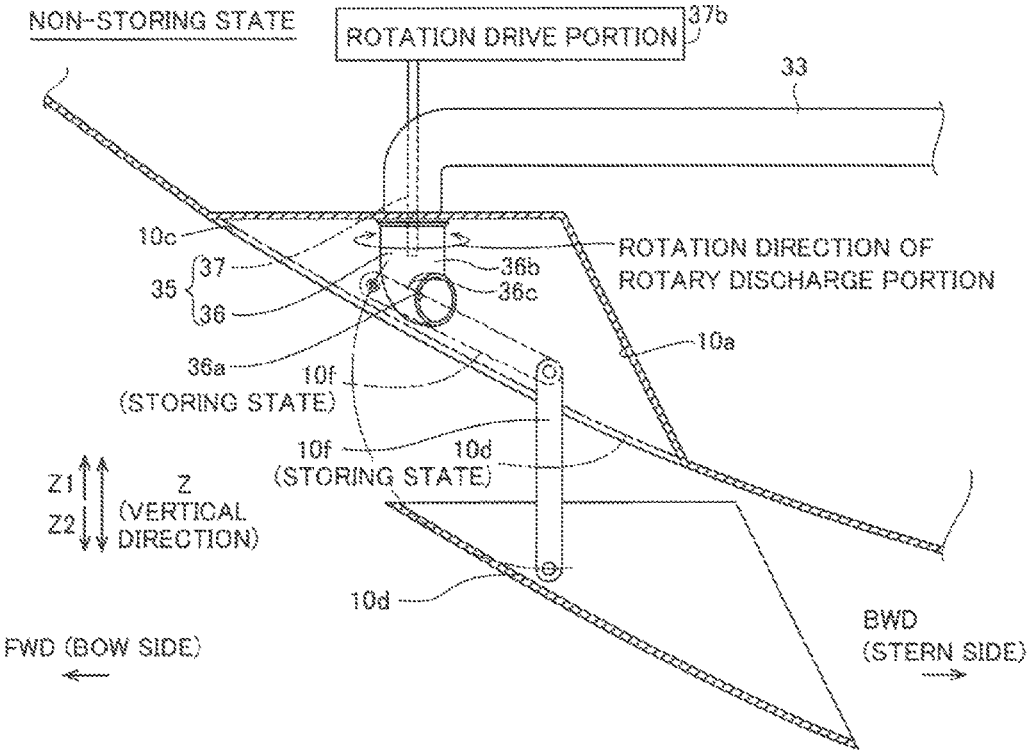
FIG. 7 is a sectional view showing a portion around a rotary discharge portion of the jet propulsion boat according to the first embodiment of the present invention.
Figure 8:
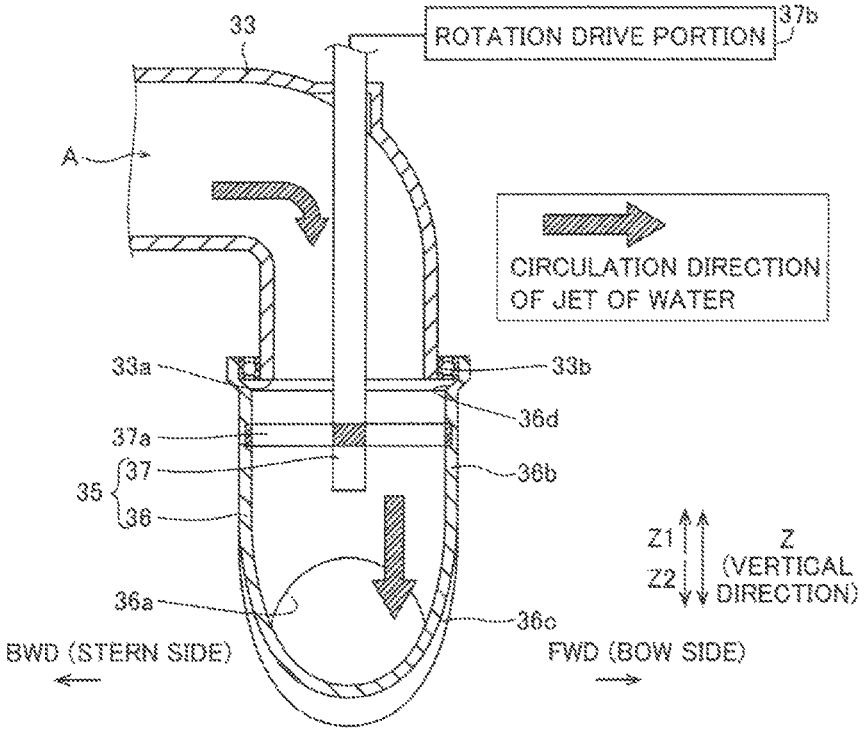
FIG. 8 is an enlarged sectional view showing the rotary discharge portion of the jet propulsion boat according to the first embodiment of the present invention.

According to the first embodiment, the rotary discharge portion 35 includes a hollow (pipe-shaped) tube member 36 provided with the discharge port 36*a* and a rotary shaft 37 mounted on the tube member 36, as shown in FIGS. 7 and 8. The tube member 36 is rotatable 360 degrees in the horizontal plane and is L-shaped. An upper end of the tube member 36 opposite to the discharge port 36*a* is connected to the end 33*a* of the branched path 33 that opens downward. The end 33*a* of the branched path 33 is inserted into the tube member 36 through a bearing 33*b*. Thus, the tube member 36 is rotated in the horizontal plane regardless of the fixed branched path 33, and the jet of water is supplied to the tube member 36 from above (Z1 side) through the branched path 33. The three-way valve 34 and the rotary discharge portion 35 are examples of the "jet control valve" and the "second discharge portion" in the present invention, respectively.

As shown in FIG. 8, the L-shaped tube member 36 includes a first tube portion 36*b* that extends in a vertical direction and a second tube portion 36*c* that extends in a horizontal direction. An upper end of the first tube portion 36*c* is provided with an intake port 36*d* to which the jet of water is supplied from the branched path 33, and a lower end of the first tube portion 36*c* is connected to the second tube portion 36*c*. A portion of the second tube portion 36*c* opposite to a portion of the second tube portion 36*c* connected to the first tube portion 36*b* is provided with the discharge port 36*a*. The tube member 36 is rotated by an arbitrary angle in the horizontal plane so that the jet of water supplied from the branched path 33 is discharged in the arbitrary direction in the horizontal direction from the discharge port 36*a* of the tube member 36. Thus, the discharge direction of the discharge port 36*a* is changed. The discharge port 36*a* is an example of the "second discharge port" in the present invention.

The rotary shaft 37 is mounted on an inner portion of the tube member 36 by a mounting member 37*a* that extends in the horizontal direction. The rotary shaft 37 is connected to a rotation drive portion 37*b*, and the rotation drive portion 37*b* is driven so that the rotary shaft 37 is rotated about an axis. The rotary shaft 37 is rotated, whereby the tube member 36 is rotated by 360 degrees in the horizontal plane. The rotation drive portion 37*b* is an example of the "drive source" in the present invention. The rotation drive portion 37*b* may be a part of the rotary discharge portion 35 or separate therefrom.

The rotary discharge portion 35 is arranged in the storing portion 10*a* of the hull 10 of the boat body 1, as shown in FIG. 7. The storing portion 10*a* is provided with a lid 10*d* configured to cover an opening 10*c* of the storing portion 10*a*. The lid 10*d* is mounted with a hinge 10*f* driven by a hinge drive portion 10*e* (see FIG. 9). Consequently, the storing portion 10*a* switches between a storing state where the hinge 10*f* causes the lid 10*d* to cover the opening 10*c* (a two-dot chain line in FIG. 7) to close the opening 10*c*, and a non-storing state where the hinge 10*f* causes the lid 10*d* not to cover the opening 10*c* (a solid line in FIG. 7) to open the opening 10*c*. The rotary discharge portion 35 is stored in the storing portion 10*a* not to be exposed in the storing state and is exposed in the non-storing state. One rotary discharge portion 35 is provided in a forward direction (front portion) relative to the center of gravity G of the boat body 1 on the centerline C, as shown in FIG. 2.

<Structure of Control System>

Figure 9:
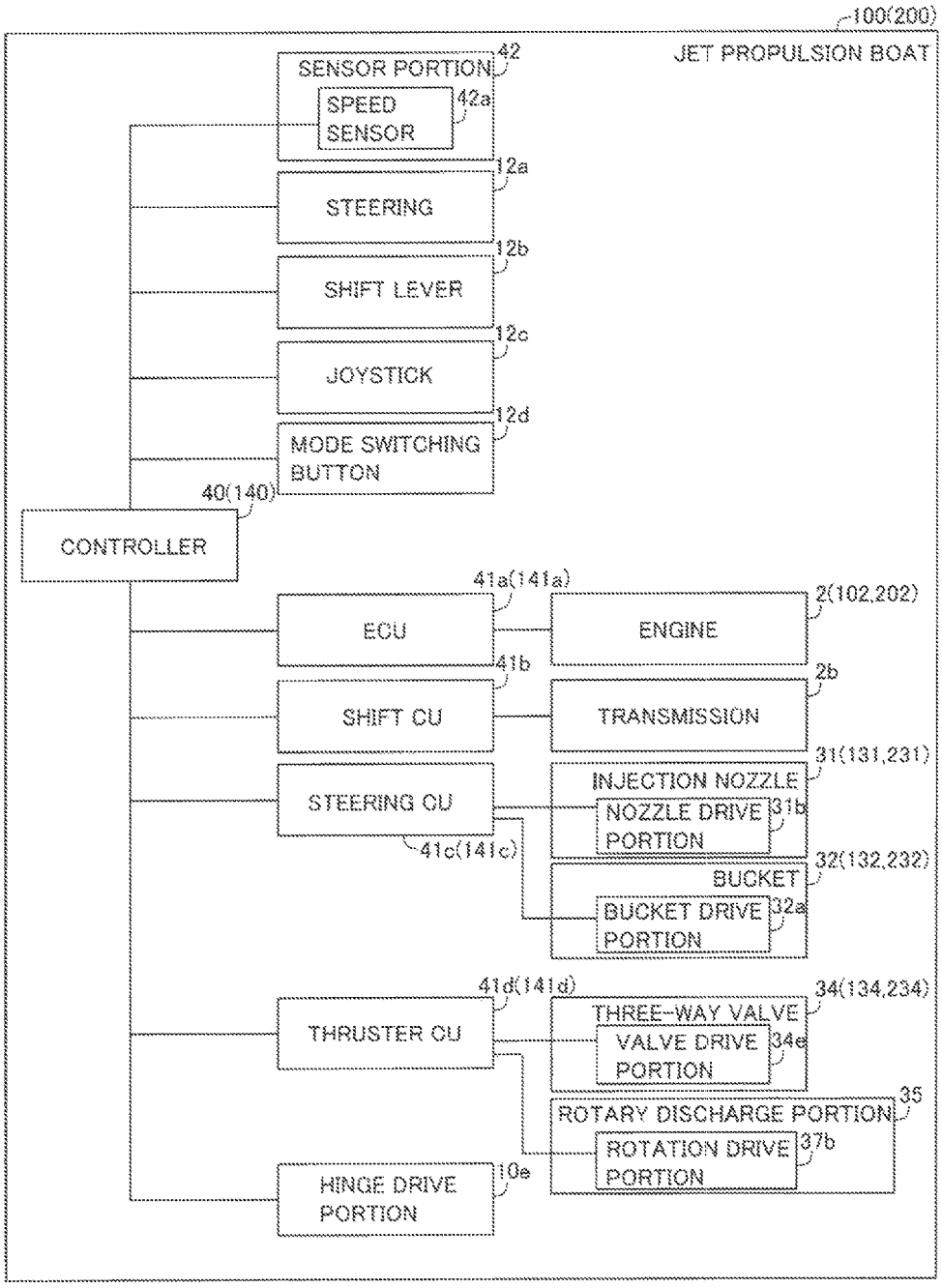
FIG. 9 is a block diagram of a jet propulsion boat according to each of first and second embodiments of the present invention.

The jet propulsion boat 100 includes a controller 40, an ECU (engine control unit) 41*a*, a shift CU (control unit) 41*b*, a steering CU 41*c*, and a thruster CU 41*d* as a control system, as shown in FIG. 9. The controller 40 and the thruster CU 41*d* are examples of the "valve controller" in the present invention.

The controller 40 includes a CPU or the like and totally controls the jet propulsion boat 100. The ECU 41*a* controls the drive of the engine 2 according to the amount of push of the shift lever 12*b* or the joystick 12*c* on the basis of an instruction from the controller 40. The shift CU 41*b* controls switching of the transmission 2*b* according to the amount of push of the shift lever 12*b* or the joystick 12*c* on the basis of an instruction from the controller 40. The steering CU 41*c* drives the nozzle drive portion 31*b* and the bucket drive portion 32*a* according to the rotation angle of the steering 12*a* or the push direction of the joystick 12*c* on the basis of an instruction from the controller 40. Thus, the rotation of the injection nozzle 31 and the rotation of the bucket 32 are controlled. The thruster CU 41*d* drives the valve drive portion 34*e* and the rotation drive portion 37*b* according to the rotation angle of the steering 12*a* or the push direction of the joystick 12*c* on the basis of an instruction from the controller 40. Thus, the switching of the three-way valve 34 (the movement of the water stop valve 34*d*) and the rotation of the tube member 36 of the rotary discharge portion 35 in the horizontal plane are controlled.

The jet propulsion boat 100 further includes a sensor portion 42 configured to detect the state of the jet propulsion boat 100. The sensor portion 42 includes a speed sensor 42*a* configured to detect the speed of the boat body 1 (boat speed) from the rotational speed of the engine 2.

The controller 40 switches between the steering operation mode of accepting operation of the user on the steering 12*a* and the joystick operation mode of accepting operation of the user on the joystick 12*c* when the mode switching mode 12*d* is pressed down. When switching the steering operation mode to the joystick operation mode (when the mode switching button 12*d* is pressed down), the controller 40 switches the steering operation mode to the joystick operation mode if the boat speed detected by the speed sensor 42*a* is not more than a prescribed speed but does not switch the steering operation mode to the joystick operation mode if the boat speed is more than the prescribed speed.

<Steering Control in Steering Operation Mode>

Steering control performed by the controller 40 in the steering operation mode is now described with reference to FIGS. 7, 9, and 10.

In the steering operation mode, the controller 40 accepts operation of the user on the steering 12*a* and the shift lever 12*b* (see FIG. 9) but does not accept operation of the user on the joystick 12*c* (see FIG. 9).

When the movement direction of the jet propulsion boat 100 is forward (FWD) or in an angular range (storing angular range) of a prescribed angle (±40 degrees, for example) from FWD in the steering operation mode, the rotary discharge portion 35 is in the storing state (see FIG. 7) where the lid 10*d* covers the opening 10*c* of the storing portion 10*a* while the jet of water is discharged by a prescribed amount in a prescribed discharge direction from only the injection nozzle 31 to move the boat body 1. The rotary discharge portion 35 is stored in the storing portion 10*a*, whereby the possibility that the rotary discharge portion 35 serves as a resistance during propulsion is significantly reduced in the steering operation mode that enables high-speed movement. When the movement direction of the jet propulsion boat 100 is not forward (FWD) or in the storing angular range in the steering operation mode, on the other hand, the rotary discharge portion 35 is in the non-storing state (see FIG. 7) where the lid 10*d* does not cover the opening 10*c* of the storing portion 10*a* while the jet of water is discharged by prescribed amounts in prescribed discharge directions from both the rotary discharge portion 35 and the injection nozzle 31.

The discharge direction and the discharge amount of each of the discharge port 36*a* of the rotary discharge portion 35 and the discharge port 31*a* of the injection nozzle 31 are determined by the controller 40 according to the rotation angle of the steering 12*a* and the amount of push of the shift lever 12*b* during the boat operation of the user. The controller 40 properly controls the engine 2, the transmission 2*b*, and the jet propulsion unit 3 through the ECU 41*a*, the shift CU 41*b*, the steering CU 41*c*, and the thruster CU 41*d* according to the determined discharge direction and discharge amount.

The injection nozzle 31 is rotationally driven by the nozzle drive portion 31*b* while the bucket 32 is rotationally driven by the bucket drive portion 32*a*, whereby the discharge direction of the discharge port 31*a* of the injection nozzle 31 is adjusted. Furthermore, the rotary discharge portion 35 is rotationally driven by the rotation drive portion 37*b*, whereby the discharge direction of the discharge port 36*a* of the rotary discharge portion 35 is adjusted. The reaction force of the jet of water from the discharge port 31*a* and the reaction force of the jet of water from the discharge port 36*a* serve as propulsion force, and the jet propulsion boat 100 is moved. The discharge direction of the discharge port 31*a* and the discharge direction of the discharge port 36*a* are made opposite to the movement direction of the jet propulsion boat 100, whereby it is not necessary to exactly adjust the discharge amount, unlike the case where the discharge portions (discharge ports) are fixedly provided.

Figure 10:
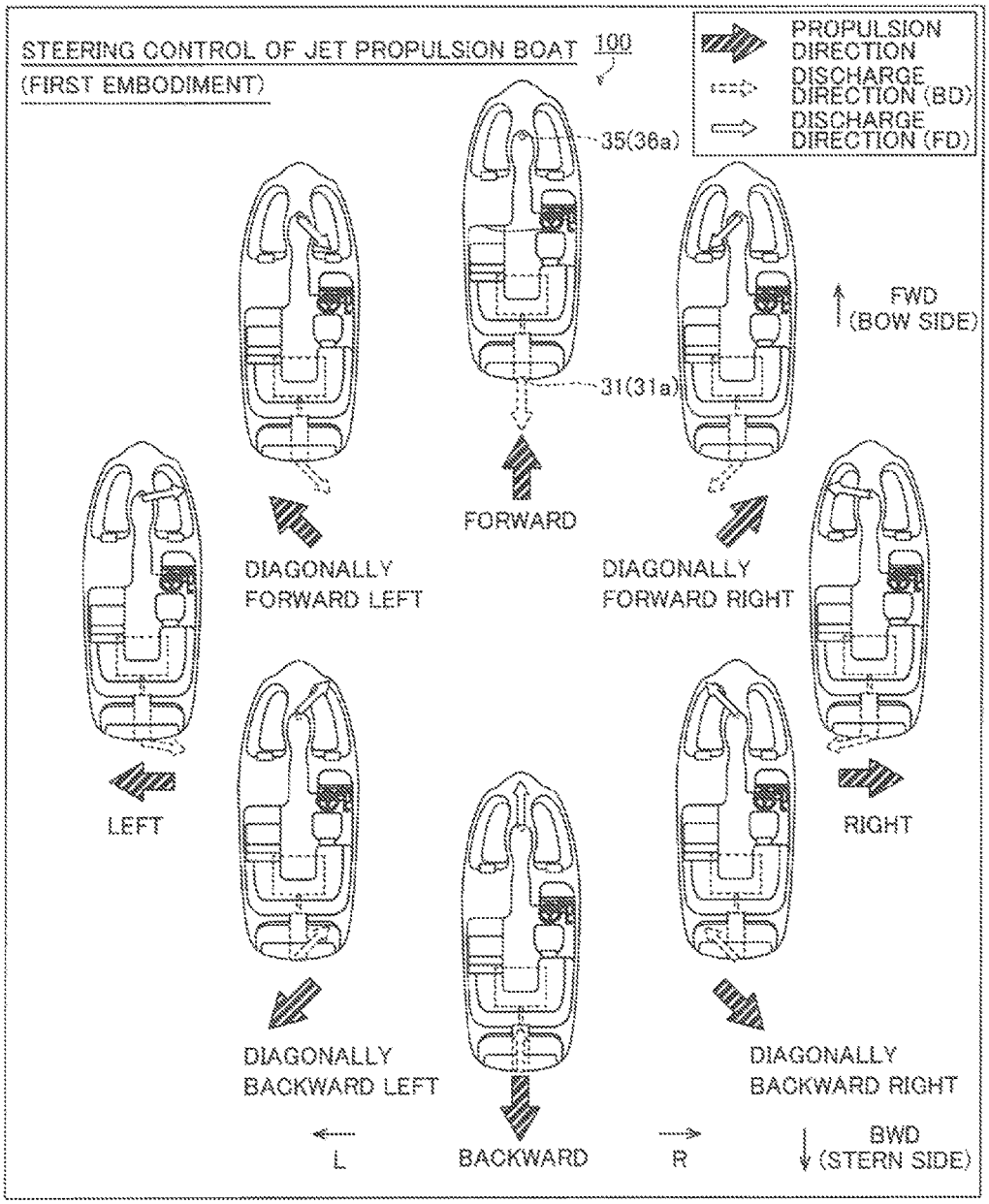
FIG. 10 illustrates steering control of the jet propulsion boat according to the first embodiment of the present invention.

Specifically, directions shown by a dotted arrow and a solid arrow in FIG. 10 are the discharge direction BD of the discharge port 31*a* and the discharge direction FD of the discharge port 36*a*, respectively. When the jet propulsion boat 100 is moved forward, for example, steering control is performed such that the discharge direction BD is backward. As described above, the rotary discharge portion 35 is in the storing state, whereby the jet of water is discharged from the rotary discharge portion 35. When the jet propulsion boat 100 is moved diagonally backward right, steering control is performed such that both the discharge directions BD and FD are diagonally forward left. When the jet propulsion boat 100 is moved left, steering control is performed such that the discharge direction BD is diagonally backward right while the discharge direction FD is diagonally forward right. At this time, propulsion force in the forward direction and propulsion force in a backward direction cancel each other out in the injection nozzle 31 and the rotary discharge portion 35 such that the jet propulsion boat 100 is moved left. At this time, the injection nozzle 31 is provided in a rear portion of the boat body 1 (the rear portion is on the stern side relative to the center of gravity G (see FIG. 2)) while the rotary discharge portion 35 is provided in a front portion of the boat body 1 (the front portion is on the bow side relative to the center of gravity G), whereby the jet propulsion boat 100 is stably moved left while the rotation of the jet propulsion boat 100 about the center of gravity G is significantly reduced or prevented.

<Steering Control in Joystick Operation Mode>

Steering control performed by the controller 40 in the joystick operation mode is now described with reference to FIGS. 7 and 9 to 12.

In the joystick operation mode, the controller 40 (see FIG. 9) accepts operation of the user on the joystick 12*c* (see FIG. 9) but does not basically accept operation of the user on the steering 12*a* and the shift lever 12*b*. When the shift lever 12*b* is pushed by at least a prescribed amount, the joystick operation mode is switched to the steering operation mode. Thus, the user can smoothly switch the joystick operation mode to the steering operation mode.

In the joystick operation mode, the jet of water is discharged by a prescribed amount in a prescribed direction from each of the discharge port 36*a* of the rotary discharge portion 35 and the discharge port 31*a* of the injection nozzle 31. At this time, the discharge direction and the discharge amount of each of the discharge port 36*a* of the rotary discharge portion 35 and the discharge port 31*a* of the injection nozzle 31 are determined by the controller 40 according to the push direction and the amount of push of the joystick 12*c* during the boat operation of the user. The controller 40 controls properly controls the engine 2, the transmission 2*b*, and the jet propulsion unit 3 through the ECU 41*a*, the shift CU 41*b*, the steering CU 41*c*, and the thruster CU 41*d* according to the determined discharge direction and discharge amount. In other words, the rotary discharge portion 35 is rotationally driven by the rotation drive portion 37*b* on the basis of the push direction of the joystick 12*c*, whereby the discharge direction of the discharge port 36*a* is adjusted. The discharge directions BD and FD in the joystick operation mode are the same as those in the steering operation mode shown in FIG. 10 when the steering of the jet propulsion boat 100 is controlled.

In the joystick operation mode, fine steering control is required, unlike in the steering operation mode, and hence the rotary discharge portion 35 is in the non-storing state (see FIG. 7) where the lid 10*d* does not cover the opening 10*c* of the storing portion 10*a* even for forward movement. Furthermore, in the joystick operation mode, a maximum speed is set, and steering control is performed such that the boat speed does not exceed the maximum speed. Thus, in the joystick operation mode, fine steering control associated with the short-distance movement of the jet propulsion boat 100 or the like is possible.

Figure 11:
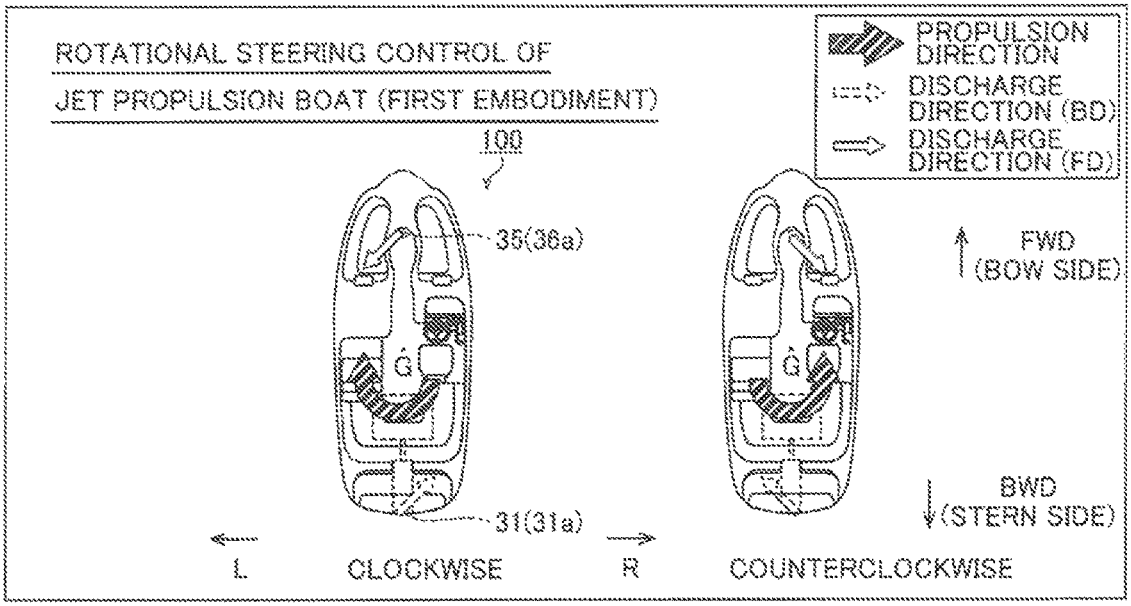
FIG. 11 illustrates rotational steering control of the jet propulsion boat according to the first embodiment of the present invention.

When the user rotationally moves the joystick 12*c* while pushing the same, steering control is performed such that the jet propulsion boat 100 is rotated, as shown in FIG. 11. When the jet propulsion boat 100 is rotated clockwise, for example, steering control is performed such that the discharge direction BD of the discharge port 31*a* of the injection nozzle 31 is diagonally forward left while the discharge direction FD of the discharge port 36*a* of the rotary discharge portion 35 is diagonally backward right. Thus, the jet propulsion boat 100 is rotated clockwise about the center of gravity G. At this time, the injection nozzle 31 is provided in the rear portion of the boat body 1 and the rotary discharge portion 35 is provided in the front portion of the boat body 1, whereby the jet propulsion boat 100 is stably rotated about the center of gravity G.

Figure 12:
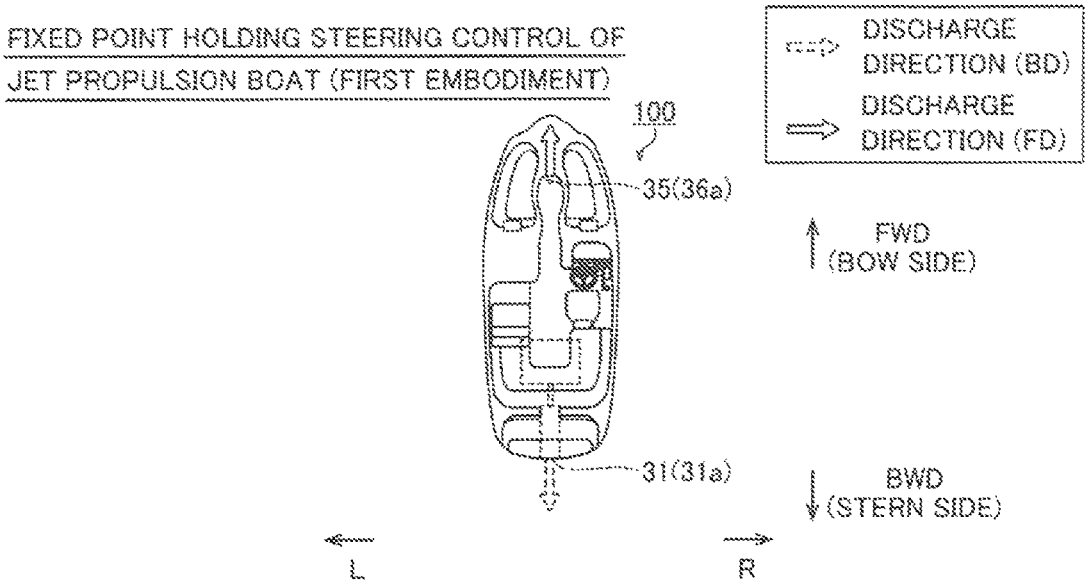
FIG. 12 illustrates fixed point holding steering control of the jet propulsion boat according to the first embodiment of the present invention.

When the user does not operate the joystick 12*c*, steering control is performed such that the jet propulsion boat 100 is held at a fixed point, as shown in FIG. 12. At this time, the controller 40 controls the three-way valve 34 to make the amount of the jet of water ejected from the discharge port 36*a* of the rotary discharge portion 35 substantially equal to the amount of the jet of water ejected from the discharge port 31*a* of the injection nozzle 31. The controller 40 performs steering control such that the discharge direction FD of the discharge port 36*a* of the rotary discharge portion 35 is opposite to the discharge direction BD of the discharge port 31*a* of the injection nozzle 31. Thus, the jet of water ejected from the discharge port 36*a* of the rotary discharge portion 35 and the jet of water ejected from the discharge port 31*a* of the injection nozzle 31 cancel each other out such that the jet propulsion boat 100 (boat body 1) is held at a fixed point. At this time, the injection nozzle 31 is provided in the rear portion of the boat body 1 and the rotary discharge portion 35 is provided in the front portion of the boat body 1, whereby the jet propulsion boat 100 is stably held at a fixed point.

(Effects of First Embodiment)

According to the first embodiment, the following effects are obtained.

According to the first embodiment, as hereinabove described, the rotary discharge portion 35 is configured to be rotatable so as to change the discharge direction of the discharge port 36*a*. Thus, the rotary discharge portion 35 is rotated to correspond to the boat operation of the user, whereby the discharge direction of the discharge port 36*a* is promptly changed, and the jet propulsion boat 100 is steered. Thus, delay in the steering of the jet propulsion boat 100 corresponding to the boat operation of the user is significantly reduced or prevented. Furthermore, the discharge direction of the discharge port 36*a* is simply changed to a second direction of a right-left direction on the basis of the boat operation of the user associated with movement in a first direction of the right-left direction, for example, whereby the jet propulsion boat 100 is easily moved in the first direction of the right-left direction without exactly controlling the amount of the jet of water discharged from the discharge port 36*a*. Thus, steering corresponding to movement in the right-left direction or the like is performed without complicating control for discharging the jet of water, and hence the delay in the steering of the jet propulsion boat 100 corresponding to the boat operation of the user is significantly reduced or prevented. Moreover, the discharge direction of the discharge port 36*a* is changed in the rotary discharge portion 35, whereby it is not necessary to provide a plurality of fixed discharge ports having discharge directions different from each other. Thus, the number of discharge ports is reduced, and hence a mechanism (jet propulsion unit 3) configured to supply the jet of water to the discharge ports is simplified while control of the amount of the jet of water is simplified. Thus, the delay in the steering of the jet propulsion boat 100 corresponding to the boat operation of the user is significantly reduced or prevented.

According to the first embodiment, as hereinabove described, the rotary discharge portion 35 is provided in the front portion of the boat body 1, whereby the boat body 1 is easily rotationally moved about the center of gravity G and is easily moved in the right-left direction while being prevented from rotation by the injection nozzle 31 and the rotary discharge portion 35 arranged in the front-back direction through the center of gravity G.

According to the first embodiment, as hereinabove described, one rotary discharge portion 35 is provided on the centerline C of the boat body 1 that extends from the bow of the boat body 1 toward the stern of the boat body 1, whereby the jet propulsion boat 100 is properly steered without providing a plurality of rotary discharge portions simply by properly rotationally controlling one rotary discharge portion 35 arranged on the centerline C. Thus, an increase in the number of components is significantly reduced or prevented, and the control of the amount of the jet of water is further simplified. Furthermore, both the rotary discharge portion 35 and the injection nozzle 31 are provided on the centerline C, whereby control for holding the boat body 1 at a fixed point or the like is more easily performed.

According to the first embodiment, as hereinabove described, the tube member 36 of the rotary discharge portion 35 is configured to be rotatable 360 degrees in the horizontal plane, and the tube member 36 is configured to be rotated by the arbitrary angle in the horizontal plane so as to change the discharge direction of the discharge port 36*a* in an arbitrary horizontal direction. Thus, the jet of water is discharged in any direction of 360 degrees in the horizontal plane from the discharge port 36*a*, and hence complication of the control for discharging the jet of water is reliably significantly reduced or prevented. Furthermore, the tube member 36 is rotated by 360 degrees in the horizontal plane, whereby the jet of water is discharged in the arbitrary direction from only one discharge port 36*a* without providing a plurality of discharge ports. Thus, an increase in the number of components is significantly reduced or prevented, and the control of the amount of the jet of water is further simplified.

According to the first embodiment, as hereinabove described, the tube member 36 of the rotary discharge portion 35 is L-shaped so as to discharge the jet of water supplied from above through the jet path A in a substantially horizontal direction from the discharge port 36*a*. Thus, the jet of water supplied from above is easily discharged in any direction of 360 degrees in the horizontal plane from the discharge port 36*a* by the L-shaped tube member 36 of the rotary discharge portion 35.

According to the first embodiment, as hereinabove described, the jet propulsion boat 100 is provided with the rotation drive portion 37*b* configured to rotationally drive the rotary discharge portion 35 so as to change the discharge direction of the discharge port 36*a*. Thus, the rotation drive portion 37*b* is controlled in the jet propulsion boat 100 such that the discharge direction of the discharge port 36*a* is automatically controlled to be a proper direction, unlike the case where the user manually rotates the rotary discharge portion 35 and sets the discharge direction of the discharge port 36*a*.

According to the first embodiment, as hereinabove described, the rotary discharge portion 35 is rotatably connected to the jet path A and includes the tube member 36 provided with the discharge port 36*a* and the rotary shaft 37 connected to the rotation drive portion 37*b*, configured to rotate the tube member 36. Thus, the discharge direction of the discharge port 36*a* of the tube member 36 is automatically changed by the drive force of the rotation drive portion 37*b* transmitted through the rotary shaft 37.

According to the first embodiment, as hereinabove described, the storing portion 10*a* configured to store the rotary discharge portion 35 is provided in the hull 10 of the boat body 1, whereby the currently-unused rotary discharge portion 35 is stored such that the possibility that the rotary discharge portion 35 serves as a resistance during propulsion is significantly reduced, and hence a reduction in the speed of the jet propulsion boat 100 (boat speed) caused by the rotary discharge portion 35 is significantly reduced or prevented.

According to the first embodiment, as hereinabove described, the openable and closable lid 10*d* is provided in the opening 10*c* of the storing portion 10*a*, whereby the rotary discharge portion 35 is easily switched to the storing state or the non-storing state by opening or closing the lid 10*d*.

According to the first embodiment, as hereinabove described, the three-way valve 34 of the jet path A is provided on the centerline C, and the branched path 33 of the jet path A is provided along arrow L relative to the centerline C of the boat body 1. Consequently, the jet path A extends from the stern side toward the bow side not to intersect with the centerline C of the boat body 1. Thus, the jet path A does not intersect with the centerline C of the boat body 1, and hence the possibility that the jet path A makes it impossible for another device (such as the engine 2) to be arranged in the vicinity of the centerline C in the boat body 1 is effectively significantly reduced or prevented.

According to the first embodiment, as hereinabove described, the jet propulsion boat 100 is provided with the three-way valve 34 provided in the jet path A and the controller 40 and the thruster CU 41*d* both configured to control the three-way valve 34 to supply the jet of water from the propulsion device 30 to at least one of the discharge port 31*a* and the discharge port 36*a*. Thus, the controller 40 and the thruster CU 41*d* are properly controlled such that the jet of water from the propulsion device 30 is properly supplied to at least one of the discharge port 31*a* and the discharge port 36*a*, and hence the control for discharging the jet of water is reliably performed. Furthermore, the openable and closable three-way valve 34 and the rotatable rotary discharge portion 35 are used together such that the delay in the steering of the jet propulsion boat 100 corresponding to the boat operation of the user is more significantly reduced or prevented as compared with the case where only the openable and closable three-way valve 34 is used.

According to the first embodiment, as hereinabove described, the rotation drive portion 37*b* is configured to rotationally drive the rotary discharge portion 35 on the basis of the push direction of the joystick 12*c* so as to adjust the discharge direction of the discharge port 36*a*. Thus, pushing operation of the user on the joystick 12*c* is reflected in the rotational drive of the rotary discharge portion 35, and hence the jet propulsion boat 100 is properly moved in a movement direction intended by the user according to the intuitive boat operation of the user through the joystick 12*c*.

According to the first embodiment, as hereinabove described, the steering operation mode of accepting operation of the user on the steering is switched to the joystick operation mode of accepting operation of the user on the joystick 12*c* when the boat speed is not more than the prescribed speed. Thus, the steering operation mode is switched to the joystick operation mode in which fine boat operation of the user is reflected when the boat speed is not more than the prescribed speed and fine steering control is possible, and hence the jet propulsion boat 100 is more properly moved in the movement direction intended by the user according to the boat operation of the user through the joystick 12*c*.

According to the first embodiment, as hereinabove described, the joystick operation mode is cancelled and is switched to the steering operation mode when the user operates the shift lever 12*b*. Thus, the user easily switches the joystick operation mode to the steering operation mode in which the shift lever 12*b* is used without performing an operation to cancel the joystick operation mode separately simply by operating the shift lever 12*b*.

According to the first embodiment, as hereinabove described, the controller 40 and the thruster CU 41*d* are configured to control the three-way valve 34 to supply the jet of water to the injection nozzle 31 and supply the jet of water to the rotary discharge portion 35 through the jet path A (branched path 33) in the joystick operation mode. Thus, the jet of water is supplied to both the injection nozzle 31 and the rotary discharge portion 35 by the controller 40 and the thruster CU 41*d* in the joystick operation mode, and hence fine steering corresponding to the movement of the jet propulsion boat 100 in the right-left direction or the like is properly performed by both the injection nozzle 31 and the rotary discharge portion 35.

According to the first embodiment, as hereinabove described, the controller 40 and the thruster CU 41*d* are configured to control the three-way valve 34 to make the amount of the jet of water supplied to the injection nozzle 31 and the amount of the jet of water supplied to the rotary discharge portion 35 substantially equal to each other and hold the boat body 1 at a fixed point by making the discharge direction of the discharge port 31*a* and the discharge direction of the discharge port 36*a* opposite to each other, when the joystick 12*c* is not operated in the joystick operation mode. Thus, the boat body 1 is reliably held at a fixed point in a state where the joystick 12*c* is not operated.

According to the first embodiment, as hereinabove described, the jet propulsion boat 100 is provided with the mode switching button 12*d* configured to enable the user to switch the steering operation mode of accepting operation of the user on the steering 12*a* to the joystick operation mode of accepting operation of the user on the joystick 12*c*. Thus, the user easily switches the steering operation mode to the joystick operation mode by pressing down the mode switching button 12*d*.

Second Embodiment

A jet propulsion boat 200 according to a second embodiment of the present invention is now described with reference to FIGS. 9 and 13 to 17. In the jet propulsion boat 200 according to the second embodiment, two propulsion devices 130 and 230 are provided, unlike in the jet propulsion boat 100 according to the aforementioned first embodiment. Portions similar to those of the jet propulsion boat 100 according to the first embodiment are denoted by the same reference numerals, to omit the description.

(Structure of Jet Propulsion Boat)

Figure 13:
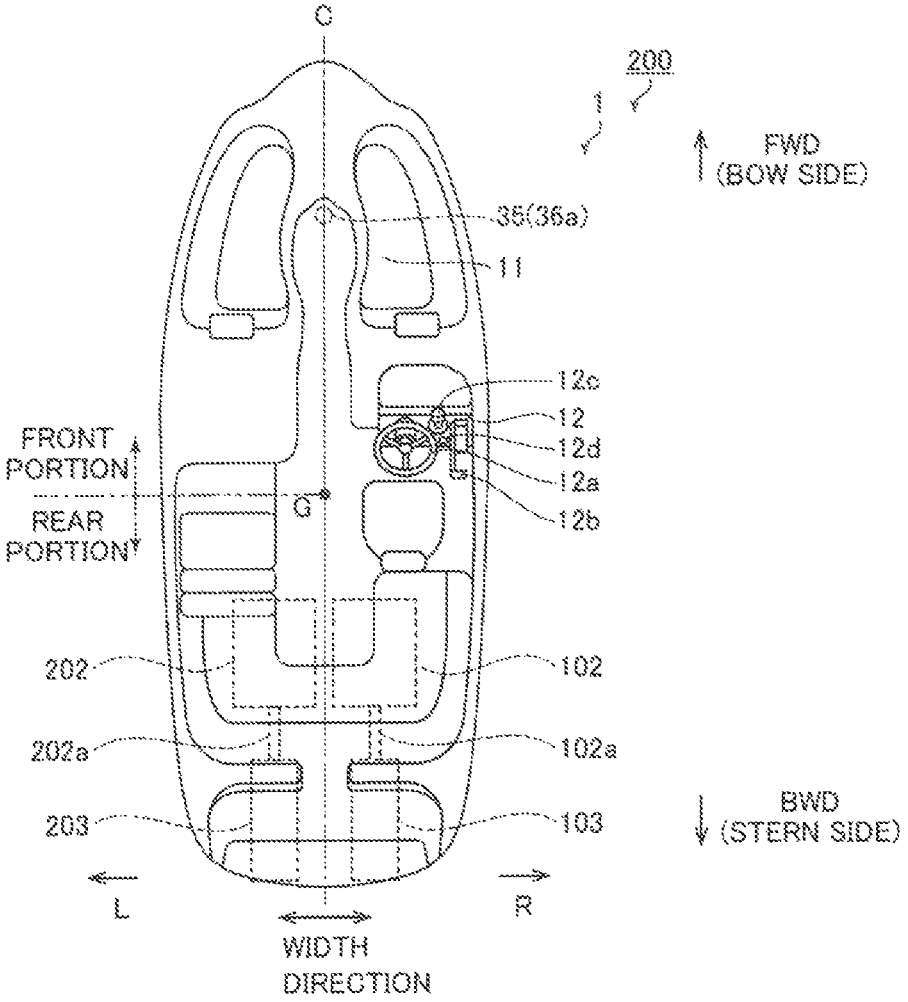
FIG. 13 is a top plan view of the jet propulsion boat according to the second embodiment of the present invention.

The jet propulsion boat 200 includes two engines 102 and 202 stored in a hull 10 of a boat body 1 and two jet propulsion units 103 and 203 connected to the engines 102 and 202, as shown in FIG. 13.

The engine 102 and the jet propulsion unit 103 are arranged along arrow R relative to a centerline C, and the engine 202 and the jet propulsion unit 203 are arranged along arrow L relative to the centerline C. The drive force of the engines 102 and 202 is transmitted to the jet propulsion units 103 and 203 through drive shafts 102*a* and 202*a* etc., respectively.

<Structure of Jet Propulsion Unit>

Figure 14:
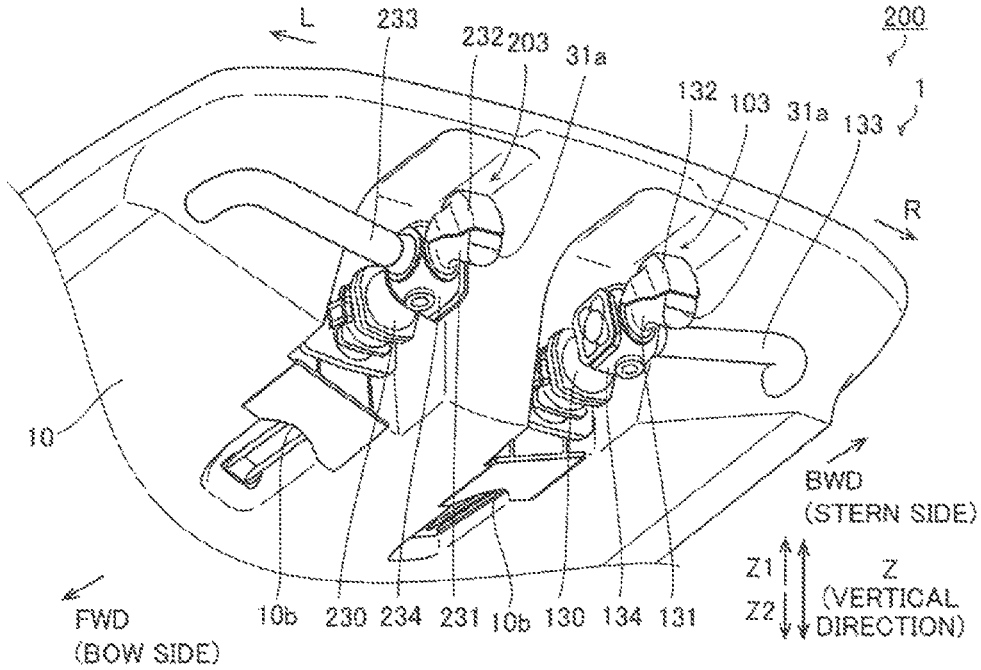
FIG. 14 is an enlarged perspective view of the jet propulsion boat according to the second embodiment of the present invention, as viewed from the rear and below.

The jet propulsion units 103 and 203 are symmetric about the centerline C, as shown in FIG. 14. Specifically, the jet propulsion units 103 and 203 include the propulsion devices 130 and 230, injection nozzles 131 and 231, and buckets 132 and 232, respectively. The jet propulsion units 103 and 203 further include branched paths 133 and 233 and three-way valves 134 and 234, respectively. The propulsion devices 130 and 230 are examples of the "first propulsion device" and the "second propulsion device" in the present invention, respectively, and the injection nozzles 131 and 231 are examples of the "one of a pair of first discharge portions" and the "the other of the pair of first discharge portions" in the present invention, respectively. The three-way valve 134 is an example of the "jet control valve" or the "first three-way control valve" in the present invention, and the three-way valve 234 is an example of the "jet control valve" or the "second three-way control valve" in the present invention.

In the jet propulsion unit 103 along arrow R, a jet path A1 (see FIG. 16) in which a jet of water from the propulsion device 130 circulates is defined by the three-way valve 134 and the branched path 133. In the jet propulsion unit 203 along arrow L, a jet path A2 (see FIG. 17) in which a jet of water from the propulsion device 230 circulates is defined by the three-way valve 234 and the branched path 233.

Figure 15:
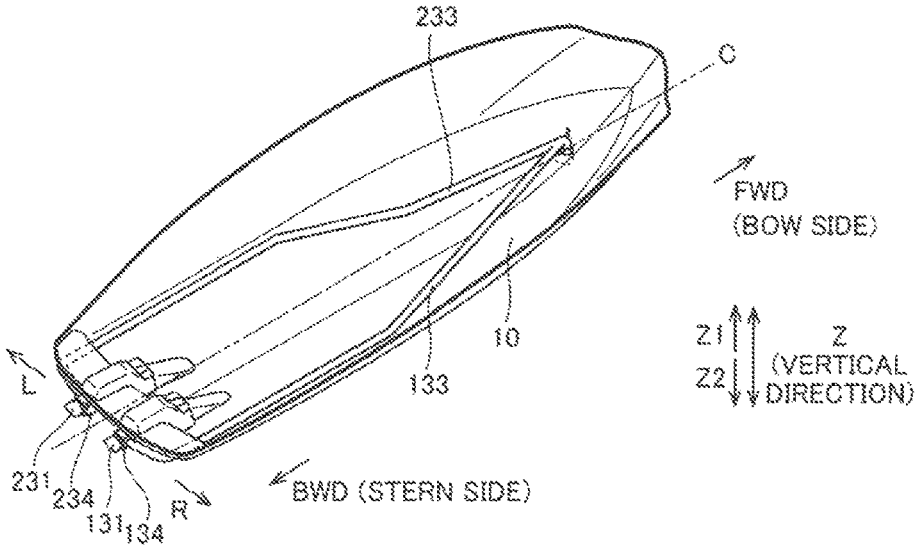
FIG. 15 is a perspective view of a boat body of the jet propulsion boat according to the second embodiment of the present invention, as viewed from above.

The branched path 133 connects the propulsion device 130 and a rotary discharge portion 35 (see FIG. 13), and the branched path 233 connects the propulsion device 230 and the rotary discharge portion 35. The branched path 133 extends from the three-way valve 134 along arrow R and is bent forward, as shown in FIG. 14. The branched path 133 passes through the boat body 1 and extends forward from a stern side toward a bow side in a portion of the hull 10 of the boat body 1 along arrow R, as shown in FIG. 15. Thus, the branched path 133 is provided along arrow R relative to the centerline C of the boat body 1. The branched path 233 extends from the three-way valve 234 along arrow L and is bent forward, as shown in FIG. 14. The branched path 233 passes through the boat body 1 and extends forward from the stern side toward the bow side in a portion of the hull 10 of the boat body 1 along arrow L, as shown in FIG. 15. Thus, the branched path 233 is provided along arrow L relative to the centerline C of the boat body 1. The branched paths 133 and 233 are connected to each other above the rotary discharge portion 35 on the centerline C of the boat body 1. Consequently, the jet paths A1 and A2 are provided not to intersect with the centerline C.

One rotary discharge portion 35 is provided on the centerline C of the boat body 1 in a forward direction, similarly to the aforementioned first embodiment, as shown in FIG. 13.

Figure 16:
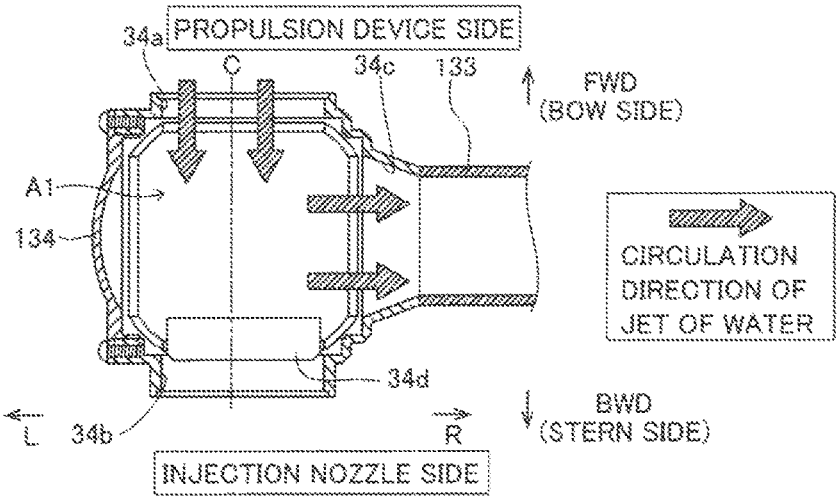
FIG. 16 is a sectional view showing a three-way valve along arrow R of the jet propulsion boat according to the second embodiment of the present invention.
Figure 17:
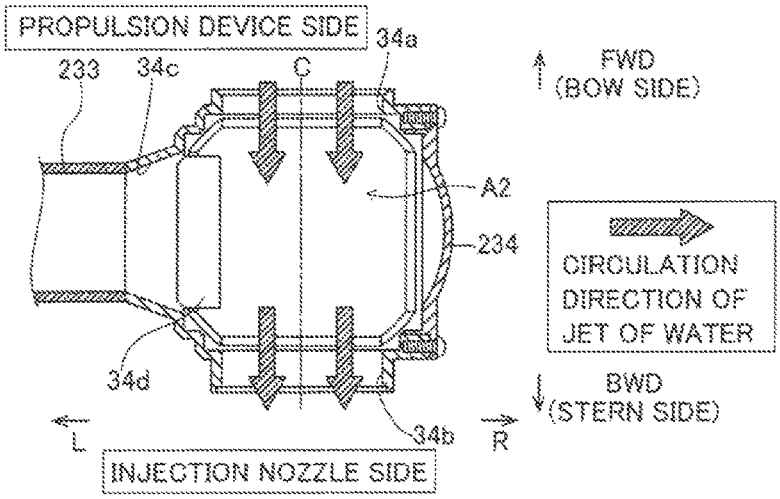
FIG. 17 is a sectional view showing a three-way valve along arrow L of the jet propulsion boat according to the second embodiment of the present invention.

As shown in FIG. 16, the three-way valve 134 is provided in a portion where the jet path A1 is branched between the propulsion device 130 and the injection nozzle 131. Similarly, the three-way valve 234 is provided in a portion where the jet path A2 is branched between the propulsion device 230 and the injection nozzle 231, as shown in FIG. 17. The three-way valve 134 is configured to supply the jet of water generated in the propulsion device 130 to either the injection nozzle 131 or the branched path 133, unlike the three-way valve 34 according to the aforementioned first embodiment. Similarly, the three-way valve 234 is configured to supply the jet of water generated in the propulsion device 230 to either the injection nozzle 231 or the branched path 233. A water stop valve 34*d* of each of the three-way valves 134 and 234 is configured to be movable between a first position where the water stop valve 34*d* closes an opening 34*c* and a second position where the water stop valve 34*d* closes an opening 34*b*. Consequently, it is not necessary to move the water stop valves 34*d* of the three-way valves 134 and 234 in response to boat operation of a user except for the case where the steering direction of the jet propulsion boat 200 is significantly changed such that the position of the water stop valve 34*d* of each of the three-way valves 134 and 234 is switched to either the first position or the second position, and hence delay in the steering of the jet propulsion boat 200 corresponding to the boat operation of the user is effectively significantly reduced or prevented.

<Structure of Control System>

The jet propulsion boat 200 includes a controller 140, an ECU 141*a*, a shift CU 41*b*, a steering CU 141*c*, and a thruster CU 141*d* as a control system, as shown in FIG. 9. The controller 140 and the thruster CU 141*d* are examples of the "valve controller" in the present invention.

The controller 140 totally controls the jet propulsion boat 200. The ECU 141*a* controls the drive of the engines 102 and 202 according to the amount of push of a shift lever 12*b* or a joystick 12*c* on the basis of an instruction from the controller 140. The steering CU 141*c* controls the rotation of the injection nozzles 131 and 231 and the rotation of the buckets 132 and 232 according to the rotation angle of the steering 12*a* or the push direction of the joystick 12*c* on the basis of an instruction from the controller 140. The thruster CU 141*d* controls the switching of the three-way valves 134 and 234 and the rotation of the rotary discharge portion 35 according to the rotation angle of the steering 12*a* or the push direction of the joystick 12*c* on the basis of an instruction from the controller 140. The remaining structure of the jet propulsion boat 200 according to the second embodiment is similar to that of the jet propulsion boat 100 according to the aforementioned first embodiment.

<Steering Control in Steering Operation Mode>

Steering control performed by the controller 140 in a steering operation mode is now described with reference to FIGS. 9 and 18. The description of steering control similar to that according to the aforementioned first embodiment is omitted.

Figure 18:
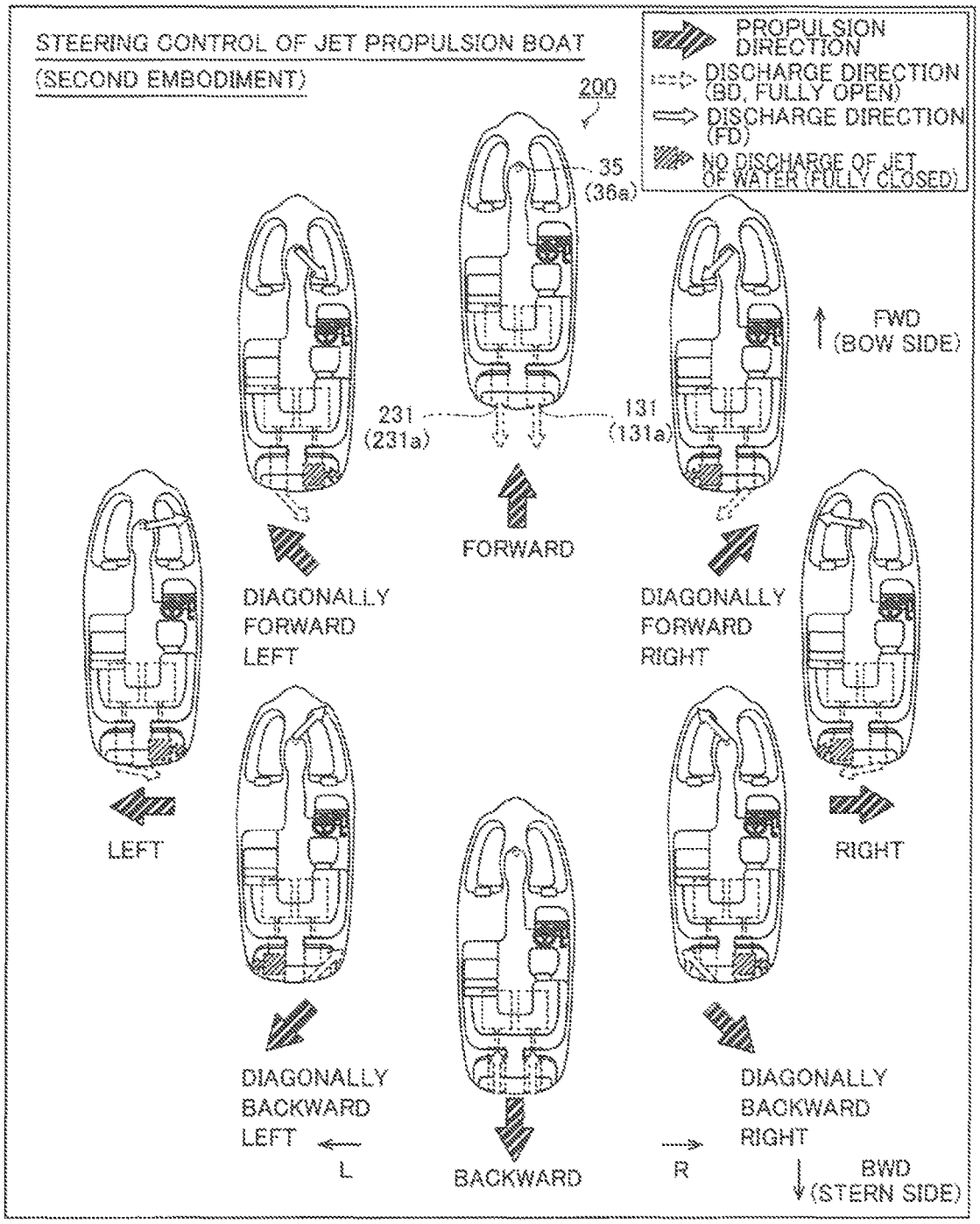
FIG. 18 illustrates steering control of the jet propulsion boat according to the second embodiment of the present invention.

In the steering operation mode, the jets of water are discharged by prescribed amounts in prescribed directions from two of a discharge port 36*a* of the rotary discharge portion 35, a discharge port 131*a* of the injection nozzle 131, and a discharge port 231*a* of the injection nozzle 231, as shown in FIG. 18. The discharge direction and the discharge amount of each of the three discharge ports are determined by the controller 140 (see FIG. 9) according to the rotation angle of the steering 12*a* and the amount of push of the shift lever 12*b* (see FIG. 9) during the boat operation of the user.

Specifically, directions shown by a dotted arrow and a solid arrow in FIG. 18 are the discharge direction BD of the discharge port 131*a* of the injection nozzle 131 along arrow R, the discharge direction BD of the discharge port 231*a* of the injection nozzle 231 along arrow L, and the discharge direction FD of the discharge port 36*a* of the rotary discharge portion 35. When the jet propulsion boat 200 is moved forward (straight), for example, steering control is performed such that both the discharge direction BD of the discharge port 131*a* and the discharge direction BD of the discharge port 231*a* are backward, and no jet of water is discharged from the discharge port 36*a* of the rotary discharge portion 35. Similarly, when the jet propulsion boat 200 is moved backward, steering control is performed such that both the discharge direction BD of the discharge port 131*a* and the discharge direction BD of the discharge port 231*a* are forward, and no jet of water is discharged from the discharge port 36*a*.

When the jet propulsion boat 200 is moved diagonally backward right, the three-way valves 134 and 234 are controlled such that the jet of water is not supplied to the injection nozzle 131 along arrow R but is supplied only to the injection nozzle 231 along arrow L. Thus, the jet of water from the propulsion device 130 along arrow R is supplied to the rotary discharge portion 35. Steering control is performed such that the discharge direction BD of the discharge port 231*a* of the injection nozzle 231 along arrow L is diagonally forward left and the discharge direction FD of the discharge port 36*a* of the rotary discharge portion 35 is diagonally forward left.

When the jet propulsion boat 200 is moved right, the three-way valves 134 and 234 are controlled such that the jet of water is not supplied to the injection nozzle 231 along arrow L but is supplied only to the injection nozzle 131 along arrow R. Thus, the jet of water from the propulsion device 230 along arrow L is supplied to the rotary discharge portion 35. Steering control is performed such that the discharge direction BD of the discharge port 131*a* of the injection nozzle 131 along arrow R is diagonally backward left and the discharge direction FD of the discharge port 36*a* of the rotary discharge portion 35 is diagonally forward left. At this time, propulsion force in a forward direction and propulsion force in a backward direction cancel each other out in the injection nozzle 131 along arrow R and the rotary discharge portion 35 such that the jet propulsion boat 200 is moved right.

<Steering Control in Joystick Operation Mode>

Steering control performed by the controller 140 in a joystick operation mode is now described with reference to FIGS. 9, 18, and 19. The description of steering control similar to that according to the aforementioned first embodiment is omitted.

In the joystick operation mode, the jets of water are discharged by prescribed amounts in prescribed directions from two of the discharge port 36*a* of the rotary discharge portion 35, the discharge port 131*a* of the injection nozzle 131, and the discharge port 231*a* of the injection nozzle 231, similarly to the steering operation mode. At this time, the discharge direction and the discharge amount of each of the discharge port 36*a* of the rotary discharge portion 35, the discharge port 131*a* of the injection nozzle 131, and the discharge port 231*a* of the injection nozzle 231 are determined by the controller 140 (see FIG. 9) according to the push direction and the amount of push of the joystick 12*c* (see FIG. 9) during the boat operation of the user. The discharge directions BD and FD in the joystick operation mode are the same as those in the steering operation mode shown in FIG. 18 when the steering of the jet propulsion boat 200 is controlled.

Figure 19:
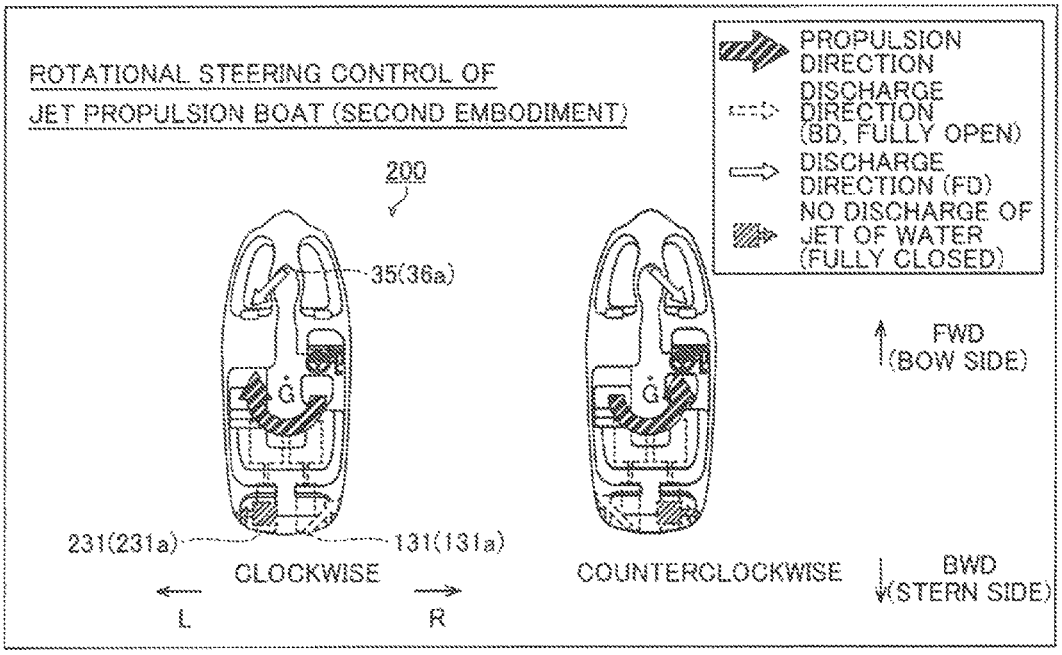
FIG. 19 illustrates rotational steering control of the jet propulsion boat according to the second embodiment of the present invention.

When the user rotationally moves the joystick 12*c* while pushing the same, steering control is performed such that the jet propulsion boat 200 is rotated, as shown in FIG. 19. Specifically, when the jet propulsion boat 200 is rotated clockwise, the three-way valves 134 and 234 are controlled such that the jet of water is not supplied to the injection nozzle 231 along arrow L but is supplied only to the injection nozzle 131 along arrow R. Thus, the jet of water from the propulsion device 230 along arrow L is supplied to the rotary discharge portion 35. Steering control is performed such that the discharge direction BD of the discharge port 131*a* of the injection nozzle 131 along arrow R is diagonally forward right and the discharge direction FD of the discharge port 36*a* of the rotary discharge portion 35 is diagonally backward left. Thus, the jet propulsion boat 200 is rotated clockwise about the center of gravity G.

When the jet propulsion boat 200 is rotated counterclockwise, on the other hand, the three-way valves 134 and 234 are controlled such that the jet of water is not supplied to the injection nozzle 131 along arrow R but is supplied only to the injection nozzle 231 along arrow L. Thus, the jet of water from the propulsion device 130 along arrow R is supplied to the rotary discharge portion 35. Steering control is performed such that the discharge direction BD of the discharge port 231*a* of the injection nozzle 231 along arrow L is diagonally forward left and the discharge direction FD of the discharge port 36*a* of the rotary discharge portion 35 is diagonally backward right. Thus, the jet propulsion boat 200 is rotated counterclockwise about the center of gravity G.

(Effects of Second Embodiment)

According to the second embodiment, the following effects are obtained.

According to the second embodiment, as hereinabove described, the rotary discharge portion 35 is configured to be rotatable so as to change the discharge direction of the discharge port 36*a*. Thus, delay in the steering of the jet propulsion boat 200 corresponding to the boat operation of the user is significantly reduced or prevented, similarly to the aforementioned first embodiment.

According to the second embodiment, as hereinabove described, the controller 140 and the thruster CU 141*d* are configured to control the three-way valves 134 and 234 to supply the jet of water from one of the propulsion devices 130 and 230 to one rotary discharge portion 35. Thus, it is not necessary to control the three-way valves 134 and 234 to distribute the jets of water from the propulsion devices 130 and 230 to a plurality of rotary discharge portions, and hence complication of control for discharging the jets of water is effectively significantly reduced or prevented. Furthermore, both the propulsion devices 130 and 230 are configured to be capable of supplying the jets of water to the rotary discharge portion 35, whereby the possibility that no jet of water is unintentionally supplied to the rotary discharge portion 35 due to mechanical failure or the like is significantly reduced or prevented, as compared with the case where only one of the propulsion devices 130 and 230 is connected to the rotary discharge portion 35 so as to supply the jet of water to the rotary discharge portion 35.

According to the second embodiment, as hereinabove described, the controller 140 and the thruster CU 141*d* are configured to control the three-way valves 134 and 234 to selectively supply the jets of water to two of the rotary discharge portion 35, the injection nozzle 131, and the injection nozzle 231. Thus, the controller 140 and the thruster CU 141*d* control the three-way valves 134 and 234 to properly supply the jets of water to two of the rotary discharge portion 35, the injection nozzle 131, and the injection nozzle 231, whereby the control for discharging the jets of water is more reliably performed.

According to the second embodiment, as hereinabove described, the controller 140 and the thruster CU 141*d* are configured to control the three-way valve 134 to supply the jet of water from the propulsion device 130 to the injection nozzle 131 and control the three-way valve 234 to supply the jet of water from the propulsion device 230 to the injection nozzle 231, when the boat body 1 is moved forward or backward. Thus, the boat body 1 is propelled by the jets of water discharged from the discharge port 131*a* and the discharge port 231*a* in the case of forward movement or backward movement not requiring fine steering control, and hence it is not necessary to rotationally control the rotary discharge portion 35. Therefore, control of the jet propulsion boat 200 during forward movement or backward movement is simplified. The remaining effects of the second embodiment are similar to those of the aforementioned first embodiment.

MODIFICATION

The embodiments disclosed this time must be considered as illustrative in all points and not restrictive. The range of the present invention is shown not by the above description of the embodiments but by the scope of claims for patent, and all modifications within the meaning and range equivalent to the scope of claims for patent are further included.

For example, while the tube member 36 of the rotary discharge portion 35 that is rotatable 360 degrees in the horizontal plane is rotated by the arbitrary angle in the horizontal plane such that the jet of water is discharged in any direction of 360 degrees in the horizontal plane from the discharge port 36*a* of the rotary discharge portion 35 in the aforementioned first embodiment, the present invention is not restricted to this. According to the present invention, the tube member of the rotary discharge portion may alternatively be rotatable less than 360 degrees in the horizontal plane. In this case, a plurality of discharge ports and a switching portion that switches a discharge port from which a jet of water is discharged are preferably provided in the tube member such that the jet of water is discharged in any direction of 360 degrees in the horizontal plane from the discharge port. For example, the tube member of the rotary discharge portion is configured to be rotatable 180 degrees in the horizontal plane, and two discharge ports are provided at an angular interval of 180 degrees in the tube member while the switching portion that switches the two discharge ports is provided in the tube member. The rotation of the tube member and the switching of the switching portion are controlled such that the jet of water is discharged in any direction of 360 degrees in the horizontal plane.

While the storing portion 10*a* that stores the rotary discharge portion 35 is provided in the aforementioned first embodiment, the present invention is not restricted to this. According to the present invention, no storing portion may be provided. Furthermore, a mechanism configured to move the rotary discharge portion downward to the outside of the storing portion when the rotary discharge portion is not stored in the storing portion and to move the rotary discharge portion upward to the inside of the storing portion when the rotary discharge portion is stored in the storing portion may be provided in the boat body.

While the three-way valve 134 is switched such that the jet of water is supplied to either the injection nozzle 131 or the branched path 133 and the three-way valve 234 is switched such that the jet of water is supplied to either the injection nozzle 231 or the branched path 233 in the aforementioned second embodiment, the present invention is not restricted to this. According to the present invention, the three-way valve 134 may alternatively be configured to supply (distribute) the jet of water to both the injection nozzle 131 and the branched path 133, and/or the three-way valve 234 may alternatively be configured to supply (distribute) the jet of water to both the injection nozzle 231 and the branched path 233, similarly to the three-way valve 34 according to the aforementioned first embodiment.

While the three-way valve 134 along arrow R is configured to supply the jet of water generated in the propulsion device 130 to the injection nozzle 131 or the rotary discharge portion 35 through the branched path 133 and the three-way valve 234 along arrow L is configured to supply the jet of water generated in the propulsion device 230 to the injection nozzle 231 or the rotary discharge portion 35 through the branched path 233 in the aforementioned second embodiment, the present invention is not restricted to this. According to the present invention, the branched paths may alternatively be configured such that the jet of water generated in the propulsion device along arrow R is supplied to the injection nozzle along arrow L and/or the jet of water generated in the propulsion device along arrow L is supplied to the injection nozzle along arrow R.

While the jet of water is discharged only from the injection nozzle 31 when the jet propulsion boat 100 is moved forward in the aforementioned first embodiment and the jets of water are discharged only from the injection nozzles 131 and 231 when the jet propulsion boat 200 is moved forward or backward in the aforementioned second embodiment, the present invention is not restricted to this. According to the present invention, the jet of water(s) may alternatively be discharged from not only the injection nozzle(s) but also the rotary discharge portion even when the jet propulsion boat is moved forward or backward. In this case, the discharge direction of the discharge port of the rotary discharge portion is backward when the jet propulsion boat is moved forward, and the discharge direction of the discharge port of the rotary discharge portion is forward when the jet propulsion boat is moved backward.

While the three-way valve(s) 34 (134, 234) is used as the "jet control valve" according to the present invention in each of the aforementioned first and second embodiments, the present invention is not restricted to this. According to the present invention, a valve(s) other than the three-way valve(s) may alternatively be used as the "jet control valve" according to the present invention. For example, instead of the three-way valve, two common sluice valves may alternatively be provided in the jet path such that the jet of water is supplied to at least one of the branched path (rotary discharge portion) and the injection nozzle.

While one rotary discharge portion 35 is provided in each of the aforementioned first and second embodiments, the present invention is not restricted to this. According to the present invention, a plurality of rotary discharge portions (second discharge portions) may alternatively be provided. When two propulsion devices are provided as in the second embodiment, a rotary discharge portion is preferably provided for each of the two propulsion devices. Furthermore, jets of water are controlled, and hence the plurality of rotary discharge portions are preferably arranged at positions that are symmetric about the centerline in a front portion of the boat body.

What is claimed is:

1. A jet propulsion boat comprising:

a boat body;

a propulsion device configured to generate a jet of water for propelling the boat body;

a first discharge portion provided in a rear portion of the boat body, and including a first discharge port from which the jet of water is discharged;

a second discharge portion including a second discharge port from which the jet of water is discharged, the second discharge portion being configured to be rotatable so as to change a discharge direction of the second discharge port to change a direction of the jet of water discharged from the second discharge port; and a jet path configured to connect the propulsion device to the first discharge portion and the second discharge portion, wherein the boat body includes a concave storing portion that is formed at a bottom of the boat body and is configured to store at least the second discharge port of the second discharge portion inside, the concave storing portion being configured to switch between an opened state and a closed state.

2. The jet propulsion boat according to claim 1, wherein the second discharge portion is provided in a front portion of the boat body.

3. The jet propulsion boat according to claim 1, wherein the second discharge portion is provided on a centerline of the boat body that extends from a bow of the boat body toward a stern of the boat body.

4. The jet propulsion boat according to claim 1, wherein the second discharge portion is configured to be rotatable 360 degrees in a horizontal plane, further wherein the second discharge portion is configured to be rotated from a current position thereof by any arbitrary angle in the horizontal plane so as to change the discharge direction of the second discharge port.

5. The jet propulsion boat according to claim 4, wherein the second discharge portion is L-shaped so as to discharge the jet of water, which is supplied through the jet path to the second discharge portion from above the second discharge portion, in a substantially horizontal direction from the second discharge port.

6. The jet propulsion boat according to claim 1, further comprising a drive source configured to rotationally drive the second discharge portion so as to change the discharge direction of the second discharge port.

7. The jet propulsion boat according to claim 6, wherein the second discharge portion is rotatably connected to the jet path, and includes a tube member provided with the second discharge port, and a rotary shaft connected to the drive source, and configured to rotate the tube member.

8. A jet propulsion boat, comprising:

a boat body;

a propulsion device configured to generate a jet of water for propelling the boat body;

a first discharge portion provided in a rear portion of the boat body, and including a first discharge port from which the jet of water is discharged;

a second discharge portion including a second discharge port from which the jet of water is discharged, and being configured to be rotatable so as to change a discharge direction of the second discharge port to change a direction of the jet of water discharged from the second discharge port; and a jet path configured to connect the propulsion device to the first discharge portion and the second discharge portion, wherein the boat body includes a storing portion configured to store the second discharge portion, and the storing portion includes an opening, and an openable and closable lid movable relative to the opening of the storing portion to open and close the opening of the storing portion.

9. The jet propulsion boat according to claim 1, wherein a longitudinal axis of the jet path extends from a stern side toward a bow side so as to not intersect with a centerline of the boat body that extends from a bow of the boat body toward a stern of the boat body.

10. The jet propulsion boat according to claim 1, further comprising:

a jet control valve provided in the jet path; and a valve controller configured to control the jet control valve to supply the jet of water from the propulsion device to at least one of the first discharge port and the second discharge port.

11. The jet propulsion boat according to claim 10, wherein the propulsion device includes a first propulsion device and a second propulsion device, and the valve controller is configured to control the jet control valve to supply the jet of water from at least one of the first propulsion device and the second propulsion device to the second discharge port.

12. The jet propulsion boat according to claim 10, wherein the first discharge portion includes a pair of first discharge portions, the jet path includes a first jet path configured to connect the first propulsion device to the second discharge portion and a second jet path configured to connect the second propulsion device to the second discharge portion, the first propulsion device is connected to one of the pair of first discharge portions, and the second propulsion device is connected to the other of the pair of first discharge portions, the jet control valve includes a first three-way control valve provided in a portion of the first jet path where the first jet path between the first propulsion device and the one of the pair of first discharge portions is branched, and a second three-way control valve provided in a portion of the second jet path where the second jet path between the second propulsion device and the other of the pair of first discharge portions is branched, and the valve controller is configured to control the first three-way control valve and the second three-way control valve to selectively supply the jet of water to at least one of the second discharge portion, the one of the pair of first discharge portions, and the other of the pair of first discharge portions.

13. The jet propulsion boat according to claim 12, wherein the valve controller is configured to control the first three-way control valve to supply the jet of water from the first propulsion device to the one of the pair of first discharge portions and control the second three-way control valve to supply the jet of water from the second propulsion device to the other of the pair of first discharge portions, when the boat body is moved forward or backward.

14. The jet propulsion boat according to claim 6, further comprising a joystick configured to accept an operation of a user, wherein the drive source is configured to rotationally drive the second discharge portion on the basis of a push direction of the joystick so as to adjust the discharge direction of the second discharge port.

15. The jet propulsion boat according to claim 14, further comprising:

a steering operable by the user; and a valve controller switching the jet propulsion boat between a steering operation mode of accepting an operation of the steering by the user to control the boat, and a joystick operation mode of accepting the operation of the joystick by the user to control the boat, wherein the valve controller switches from the steering operation mode to the joystick operation mode when a boat speed is not more than a prescribed speed.

16. The jet propulsion boat according to claim 14, further comprising:

a steering operable by the user;

a shift lever; and a valve controller switching the jet propulsion boat between a joystick operation mode of accepting the operation of the joystick by the user to control the boat, and a steering operation mode of accepting an operation of the steering by the user to control the boat, the valve controller being configured to cancel the joystick operation mode and switch to the steering operation mode when the user operates the shift lever.

17. The jet propulsion boat according to claim 15, further comprising:

a jet control valve provided in the jet path, and wherein the valve controller is configured to control the jet control valve to supply the jet of water from the propulsion device to at least one of the first discharge port and the second discharge port, wherein in the joystick operation mode, the valve controller is configured to control the jet control valve to supply the jet of water to the first discharge portion through the jet path, and supply the jet of water to the second discharge portion through the jet path.

18. The jet propulsion boat according to claim 17, wherein, when the joystick is not operated in the joystick operation mode, the valve controller is configured to control the jet control valve to make an amount of the jet of water supplied to the first discharge portion and an amount of the jet of water supplied to the second discharge portion substantially equal to each other and hold the boat body at a fixed point by making a discharge direction of the first discharge port and the discharge direction of the second discharge port opposite to each other.

19. The jet propulsion boat according to claim 14, further comprising:

a steering operable by the user;

a valve controller switching the jet propulsion boat between a joystick operation mode of accepting the operation of the joystick by the user to control the boat, and a steering operation mode of accepting an operation of the steering by the user to control the boat; and a switching button configured to enable the user to switch the steering operation mode to the joystick operation mode.

20. The jet propulsion boat according to claim 1, further comprising a lid movable relative to the concave storing portion, to thereby cause the concave storing portion to switch between the opened state, in which an opening of the concave storing portion is not fully covered, and the closed state in which the opening of the concave storing portion is fully covered.

* * * * *